US007033048B2

(12) United States Patent
Sin

(10) Patent No.: US 7,033,048 B2
(45) Date of Patent: Apr. 25, 2006

(54) EQUIPMENT FOR HIGHLY MOUNTED LAMP HAVING ASCENDING AND DESCENDING FUNCTION

(76) Inventor: Jeong-Hoon Sin, 505-1007, Joongheung-park, 1515 Yeonhyang-dong, Suncheon-si, Jeollanam-do, 540-140, Jeollanam-do (KR)

( * ) Notice: Subject to any disclaimer, the term of this patent is extended or adjusted under 35 U.S.C. 154(b) by 175 days.

(21) Appl. No.: 10/619,984

(22) Filed: Jul. 14, 2003

(65) Prior Publication Data

US 2004/0012969 A1 Jan. 22, 2004

Related U.S. Application Data

(63) Continuation-in-part of application No. PCT/KR02/00046, filed on Jan. 11, 2002.

(30) Foreign Application Priority Data

Jan. 12, 2001 (KR) ..... 20-2001-0000918 U
Jun. 16, 2001 (KR) ..... 20-2001-0018081 U
Jun. 16, 2001 (KR) ..... 20-2001-0018082 U

(51) Int. Cl.
*F21V 1/00* (2006.01)

(52) U.S. Cl. ..... 362/404; 362/403; 362/386; 362/802; 362/286; 362/407

(58) Field of Classification Search ..... 362/386, 362/403, 407, 448, 451, 418, 404; 200/11 B
See application file for complete search history.

(56) References Cited

U.S. PATENT DOCUMENTS 4,381,539 A * 4/1983 Sakurai ..... 362/285
4,429,355 A * 1/1984 Garchinsky ..... 362/403
4,851,980 A * 7/1989 McWilliams et al. ..... 362/403
5,034,578 A * 7/1991 Lauterwald ..... 200/11 B

FOREIGN PATENT DOCUMENTS

JP 08-192995 7/1996
JP 10-203787 8/1998
KR 95-6818 3/1995
KR 1999-22569 7/1999

* cited by examiner

*Primary Examiner*—Sandra O'Shea
*Assistant Examiner*—Anabel Ton
(74) *Attorney, Agent, or Firm*—Jones Day

(57) ABSTRACT

A height adjusting device for a lamp includes a main body(100) having a motor(120), a casing(160) mounted below the main body(100), an upper terminal unit(200) having upper contact terminals(240) spaced apart from the main body(100) in the casing(160), a moving body(400) moving vertically by a cable(140) connected to the main body(100) and having lower contact terminals(420) corresponding to the terminals(240), and a stopper(300) mounted to the casing(160) to elastically maintain its horizontal state. The moving body(400) has a protrusion(430) at its side to partially contact with the stopper(300) so that the moving body(400) is hooked at a certain height by the stopper(300) when the protrusion(430) ascends over the stopper(300) and then descends, while the moving body(400) may move downward when the side ascends over the stopper(300).

14 Claims, 27 Drawing Sheets

EQUIPMENT FOR HIGHLY MOUNTED LAMP HAVING ASCENDING AND DESCENDING FUNCTION

This is a continuation-in-part of International Application No. PCT/KR02/00046 filed Jan. 11, 2002.

TECHNICAL FIELD

The present invention relates to equipment for a high-mounted lamp, and more particularly to equipment for a high-mounted lamp having ascending and descending functions, in which a moving body combined with the lamp ascends and descends along a wire rope connected to a main body so as to be possibly combined with the main body, and thereby contact terminals of the main body and the moving body always may maintain stable contact regardless of the rotation of the moving body.

BACKGROUND ART

Generally, sodium or mercury bulbs are used in extended height applications such as: hotel lobbies, factories, or streetlights. These bulbs have a limited lifecycle of approximately 5000~6000 hours requiring frequent changing and periodic maintenance. When these lamps (i.e. chandelier) are used in a hotel lobby or wedding hall, they require extra maintenance including cleaning, shining, polishing as well as changing the bulbs to maintain elegant appearance. Maintenance is done using a ladder, increasing the possibility of injury due to accidental fall.

Streetlights are usually located at a height of 7~10 m, therefore basket bracket installed crane trucks are used during maintenance of the high mounted streetlights. Furthermore, at least three workers are necessary to clean or change the high mount lamp with the crane or the ladder truck of a large size, which constitutes long hours and a very wide working area. For example, a cargo crane generally occupies one or two cranes for maintenance of a streetlight, causing traffic jam and/or accidents. Thus, the maintenance must be prompt.

For high ceiling lamps in a factory line or gymnasium, the production line and/or all activities must be stopped if the maintenance is in progress. To prevent the loss of production and time, maintenance must be done quickly.

If maintenance of the high mounted light bulbs is done improperly, it may cause the following problems: maintenance costs are increased due to the use of expensive equipments, extensive manpower, material damage and human injury with exposure to various dangers including electric shock and falling.

To minimize such problems, there have been developed operating methods and devices for descending a high mounted lamp safety to the ground where the workers are eliminating the need for them to risk climbing or being elevated up to the lamp. Upon the completion of bulb replacement or maintenance, the lamp can be ascended back to its original location.

As a device for ascending and descending a lamp from ceiling to the ground, there are 1) a manual ascending and descending device for a high mounted lamp with a wire is fixed to the lamp, in which the wire is wound around a pulley fixed to the ground so as to ascend and descend the high mounted lamp by a handle bar connected to the pulley, and 2) an automatic ascending and descending device for a high mounted lamp, which includes a motor instead of the handle bar.

The automatic ascending and descending device for a high mounted lamp is generally composed of a socket for fixing the high mounted lamp and fastened to the ceiling, a lamp unit inserted and electrically connected to the socket and having a light bulb mounted at the bottom of the socket, wire with one end fixed to the top of the lamp unit and the other end, with a predetermined length, wound around a drum installed at a certain position of the socket, and a motor for ascending and descending the lamp unit automatically by winding or releasing the wire according to user's request. Several automatic ascending and descending devices of a high mounted lamp are proposed until now, but basic structure deviates little from the above structure.

The most important part of the high mounted lamp ascending/descending device is the electrical contact between the socket and the lamp unit. Unless the socket and the lamp unit are electrically connected accurately, electricity cannot be transmitted to the bulb and the lights will not work, which is the main function of the lamps.

An example of such a contact portion of the high mounted lamp ascending/descending device is proposed in Japanese Patent Laid-open Heisei2-94312. The lamp ascending/descending device revealed in this document is composed of two wires in order to prevent gyration of the lamp unit while ascending or descending. To some extent, this technique may prevent gyration of the lamp unit itself, but has drawbacks of structural complexity and material cost increase because as two sets of the motor, the drum and the wire are needed.

In addition, Japanese Utility Laid-open Showa59-101313 discloses a male-female structure in which an upper socket is tapered at a certain angle to prevent rotation of the lamp unit so that the lamp unit may be guided and then combined into the tapered socket. But, the electrical contact is still not precise and smooth enough.

In the conventional automatic ascending/descending device of a high mounted lamp as described above, the male-female contact points do not contact each other smoothly, so they often need to ascend and descend the lamp unit several times until the contact points are properly contacted.

Due to such a problem, a lot of conventional high mounted lamp ascending/descending devices are not put into practical use in spite of their beneficial function and practicality.

DISCLOSURE OF INVENTION

The present invention is designed to overcome such drawbacks and problems of the prior art, and an object of the invention is to provide high mounted lamp equipment having ascending and descending functions, which connects a main body mounted on a certain height such as high ceiling or streetlight to a moving body, which may move vertically up and down through a wire rope, by contact terminals located at both at the main body and the moving body as circular ring shaped plates so that all of the contact terminals can maintain stable contact even when the lamp housing gyrates during the process.

In order to accomplish the above object, the present invention provides equipment for an equipment for a high mounted lamp having ascending and descending functions, which includes a main body installed to a certain height and having a drum for winding a wire rope and a motor for rotating the drum; a casing mounted under the main body and having an open bottom; an upper terminal unit installed in the casing to be spaced apart from the main body and having at least one upper contact terminal at a lower end; a moving body connected to the wire rope to be vertically movable by the motor, the moving body having a connecting unit to install a lamp thereto and a lower contact terminal mounted to an upper end thereof corresponding to the upper contact terminal; and a stopper installed to the casing for fixing the moving body in the state that the upper and lower contact terminals are contacted each other, wherein at least one of the upper and lower contact terminals has a ring shape.

Preferably, the upper contact terminals formed at the upper terminal unit include circular ring-shaped inner and outer contact terminals, and the lower contact terminals formed at the moving body include circular ring-shaped inner and outer contact terminals corresponding to the upper contact terminals.

In another case, it is possible that the upper contact terminals formed at the upper terminal unit include circular ring-shaped inner and outer contact terminals, and the lower contact terminals formed at the moving body include four contact points positioned at a same radius as the inner and outer contact terminals.

In still another case, it is also possible that the lower contact terminals formed at the moving body include circular ring-shaped inner and outer contact terminals, and the upper contact terminals formed at the upper terminal unit include four contact points positioned at a same radius as the inner and outer contact terminals.

Or else, it is also possible that the upper contact terminals formed at the upper terminal unit include circular ring-shaped inner and outer contact terminals, and the lower contact terminals formed at the moving body include two contact points positioned at a same radius as the inner and outer contact terminals.

In further another case, it is also possible that the lower contact terminals formed at the moving body include circular ring-shaped inner and outer contact terminals, and the upper contact terminals formed at the upper terminal unit include two contact points positioned at a same radius as the inner and outer contact terminals.

Preferably, a spring is installed to at least one of the upper contact terminals mounted to the upper terminal unit so as to press the corresponding upper contact terminal toward the moving body.

In an aspect of the invention, the upper and lower contact terminals are preferably formed so that a center portion is bent upward.

In this case, it is also preferred that both of the upper and lower contact terminals have ring shape.

At this time a plurality of elastic flaps may be formed in inner and outer circumferences of the ring-shaped upper contact terminal so that the elastic flaps are afloat downward rather than both ends of the upper contact terminal, and a plurality of elastic flaps may be additionally or independently formed in inner and outer circumferences of the ring-shaped lower contact terminal so that the elastic flaps are afloat upward rather than both ends of the lower contact terminal.

In an aspect of the invention, it is possible that the stopper is rotatably mounted to the casing to elastically maintain a horizontal state by a spring, and a protrusion may be formed at a side of the moving body at a position partially contacted with the stopper so that the protrusion is hooked on the stopper when descending after ascending above the stopper in order to fix the height of the moving body, while the protrusion is unhooked from the stopper when moving above the stopper in order to make the moving body be movable downward.

In this case, a contact mark is preferably mounted to a predetermined position of the wire rope and a first limit switch is installed to the main body to come in contact with the contact mark when the moving body reaches the upper terminal unit so as to drive the moving body slowly by repeatedly connecting/disconnecting power of the motor at a short interval after the first limit switch detects the contact mark during the ascent of the moving body.

At this time, it is also preferable that an additional contact mark of a predetermined length is mounted to an upper end of the wire rope so that the first limit switch comes in contact with the additional contact mark from the time that the moving body approaches near the ground during the descent of the moving body and makes the moving body descend slowly and then stop by repeatedly connecting/disconnecting power of the motor.

In addition, a guide rod may be mounted between the main body and the casing to pass through the upper terminal unit so that the upper terminal unit vertically moves along the guide rod, and a spring may also be installed to the guide rod between the upper terminal unit and the main body so as to press the upper terminal unit downward.

At this time, a second limit switch is preferably further installed to the casing for detecting that the upper terminal unit ascends to a predetermined height in order to determine a point of time that the protrusion of the moving body deviates from the stopper, and the motor may be stopped in receipt of a detect signal of the second limit switch.

Preferably, the motor, which is stopped by the detect signal of the second limit switch, is temporarily driven inversely as soon as the protrusion deviates from the stopper in order to slightly move the moving body downward.

At this time, a third limit switch may be further installed under the main body to come in contact with the upper terminal unit whether the upper terminal unit ascends so that the stopper completely deviates from the side of the moving body, and the motor may be driven inversely in receipt of a detect signal of the third limit switch to descend the moving body.

BRIEF DESCRIPTION OF THE DRAWINGS

These and other features, aspects, and advantages of preferred embodiments of the present invention will be more fully described in the following detailed description, taken accompanying drawings. In the drawings.

BEST MODES FOR CARRYING OUT THE INVENTION

Hereinafter, equipment for a high mounted lamp having ascending and descending functions according to embodiments of the present invention is described in detail with reference to the accompanying drawings.

Figure 1:
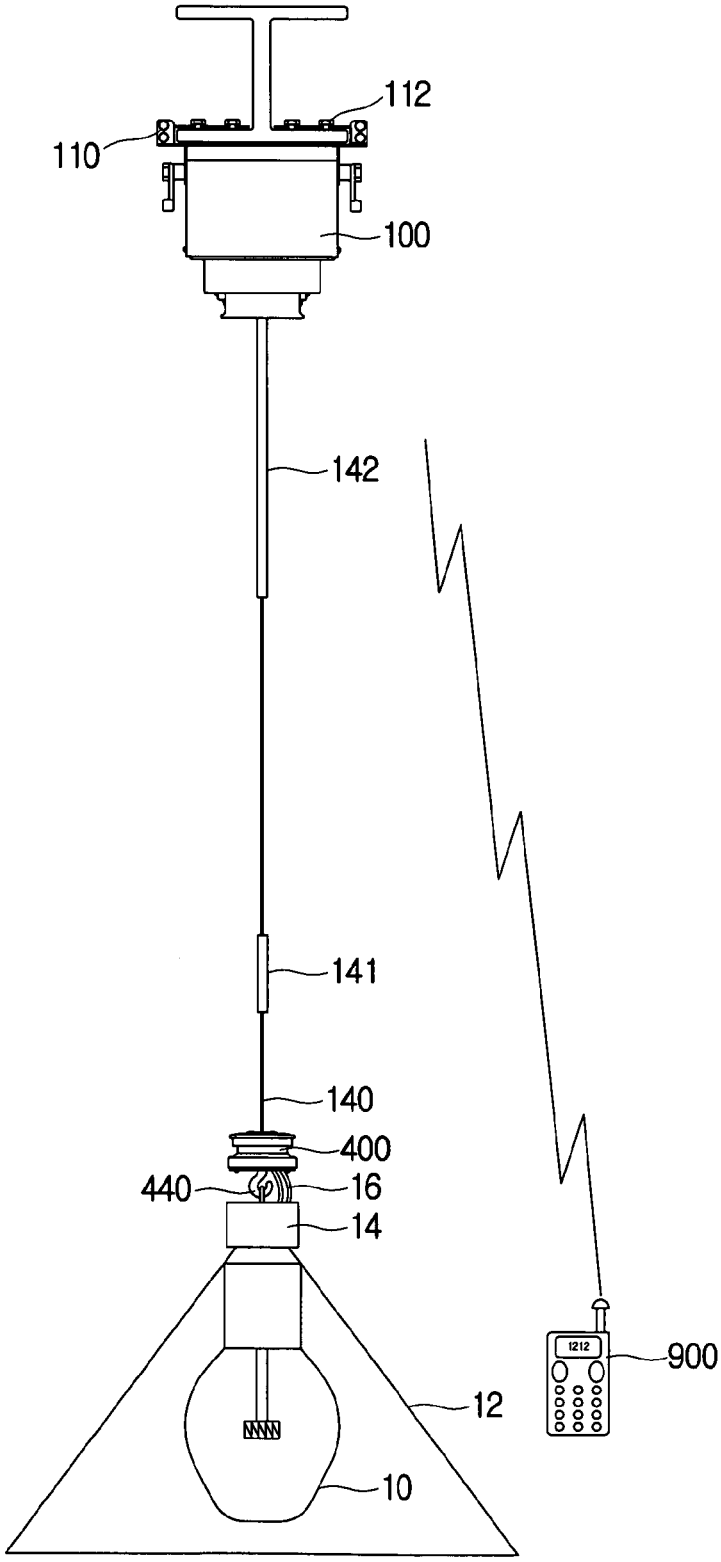
FIG. 1 is a schematic view showing that a lamp is installed to equipment for a high mounted lamp having ascending and descending functions according to the present invention in a descended state.

FIG. 1 shows a schematic configuration of equipment for a high mounted lamp having ascending and descending functions according to an embodiment of the present invention. Referring to FIG. 1, the high mounted lamp equipment of the present invention includes a main body 100 mounted to a certain height such as a ceiling of a building or a streetlight, and a moving body 400 connected to the main body 100 through a wire rope 140 to move vertically and having a lamp 10 mounted thereto. The main body 100 is combined to a support bracket 110, an end of which is mounted to an exterior structure installed to a certain height such as a ceiling of a building or a streetlight. In the figure, an H beam is adopted as an example of the exterior structure. The moving body 400 moves vertically by the wire rope 140 according to manipulation of a user, and is possibly combined with the main body 100. The lamp 10 is mounted to the moving body 400, and at this time, a connecting unit 440 for hooking the lamp 10 is mounted to a lower end of the moving body 400 and a wire 14 for supplying power to the lamp 10 is connected to the moving body 400. In addition, it is possible to form a lampshade 12 around the lamp 10 for adjusting a direction of light and a stabilizer 14 may be added. In the figure, reference numeral 900 denotes a controller for manipulating the high mounted lamp equipment of the present invention.

Figure 2:
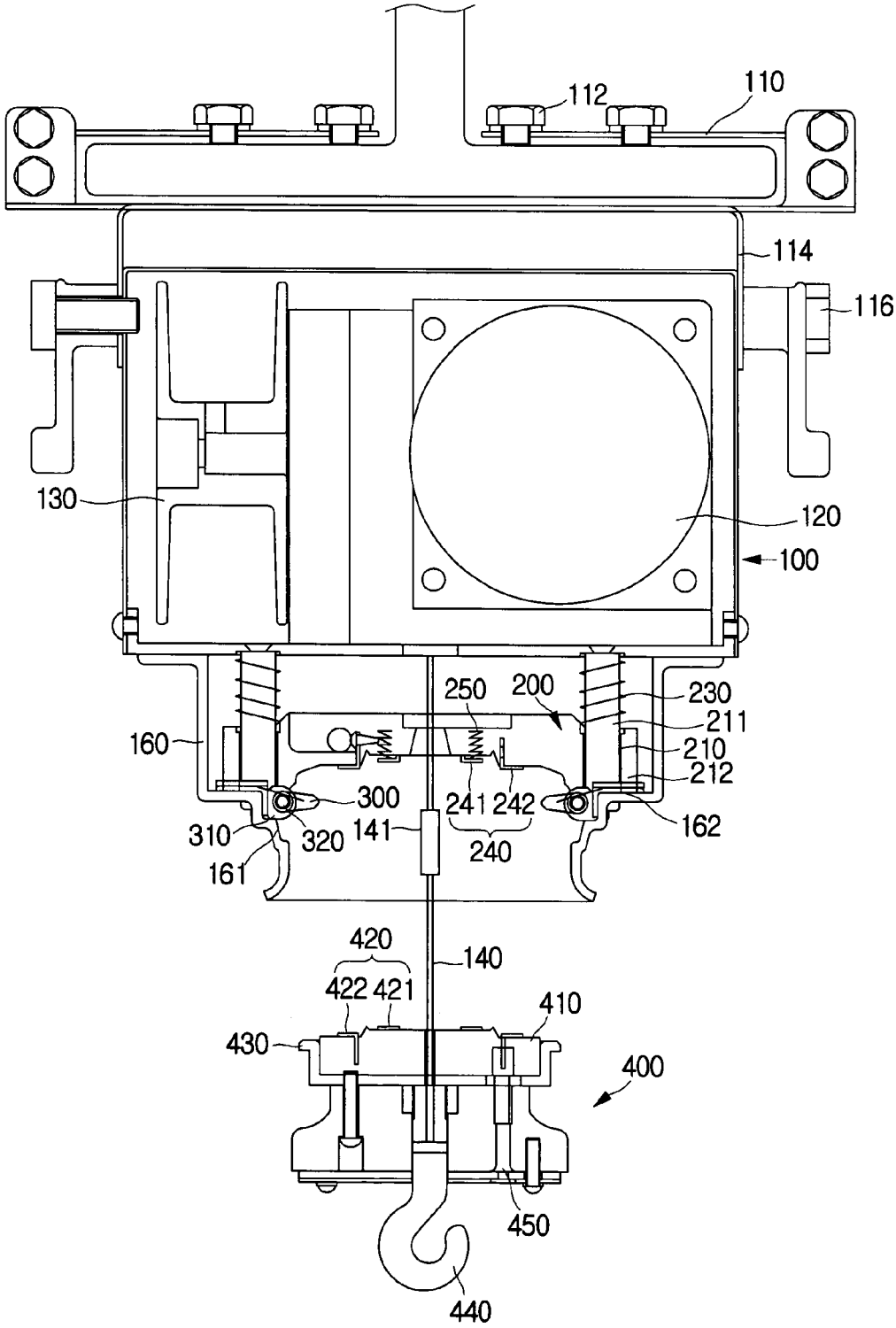
FIG. 2 is a front sectional view showing that a main body and a moving body of the high mounted lamp equipment according to the present invention are in a separated state.
Figure 3:
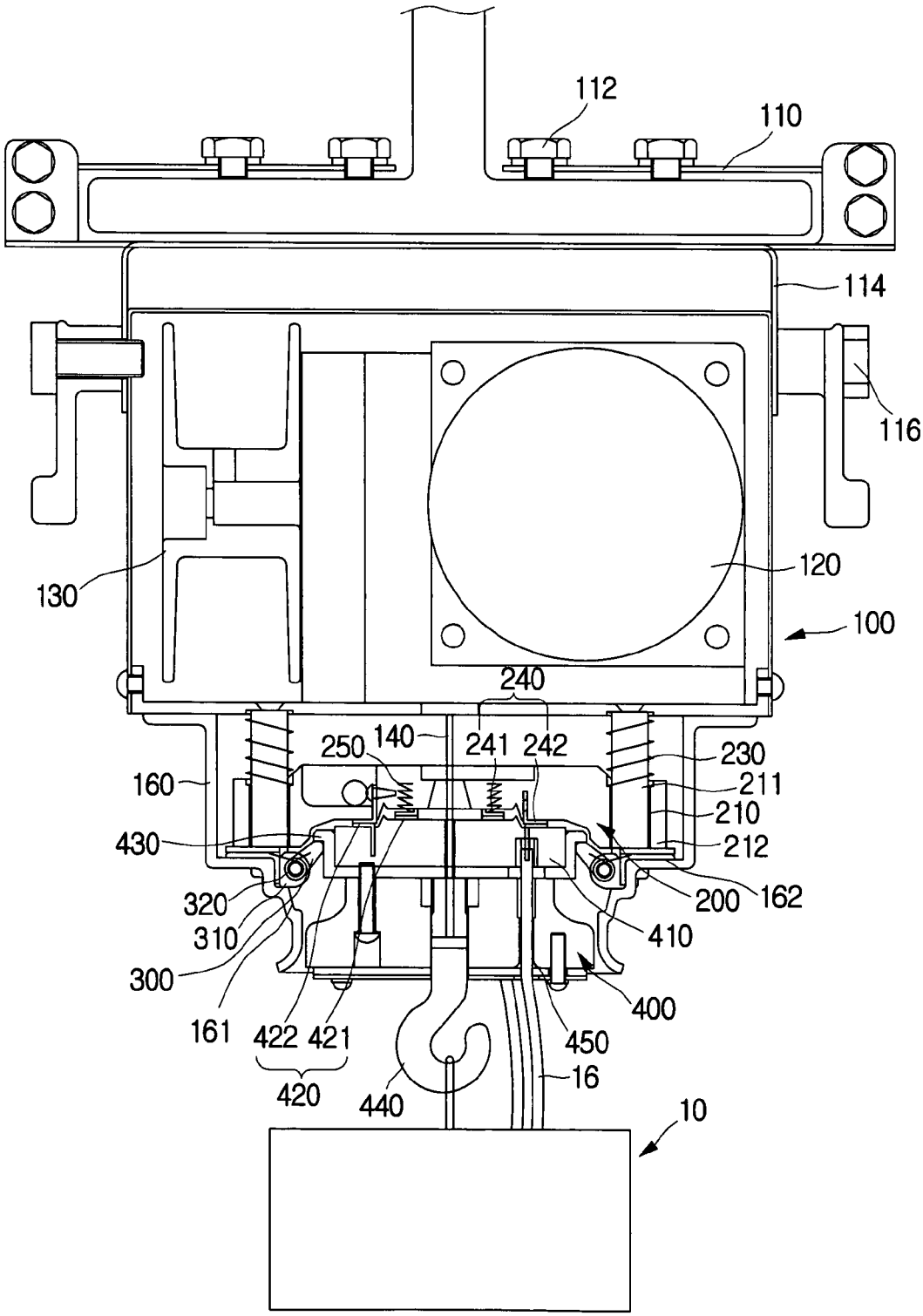
FIG. 3 is a front sectional view showing that the main body and the moving body of the high mounted lamp equipment according to the present invention are in a combined state.
Figure 4:
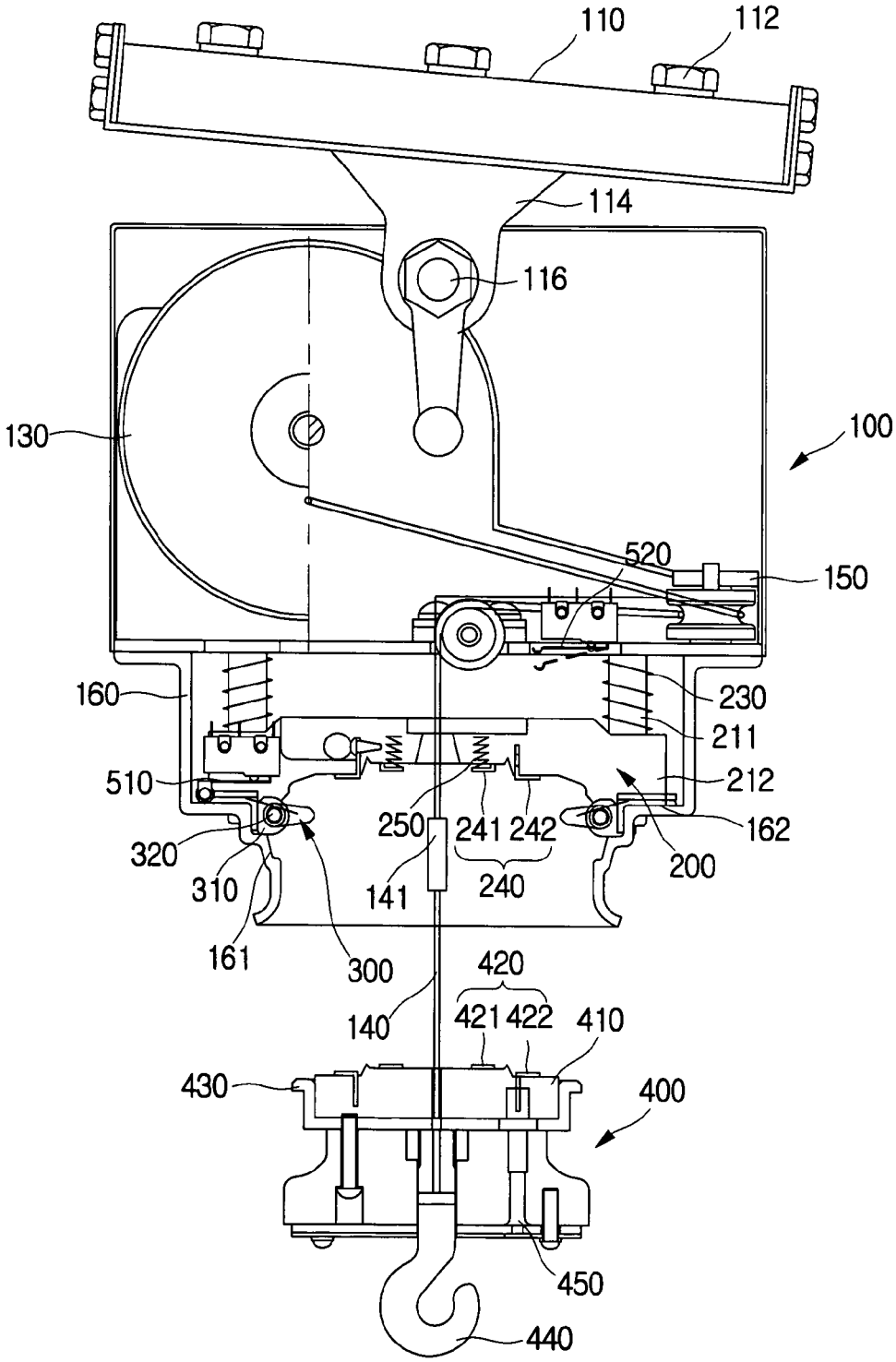
FIG. 4 is a side sectional view showing that the main body and the moving body of the high mounted lamp equipment according to the present invention are in a separated state.
Figure 5:
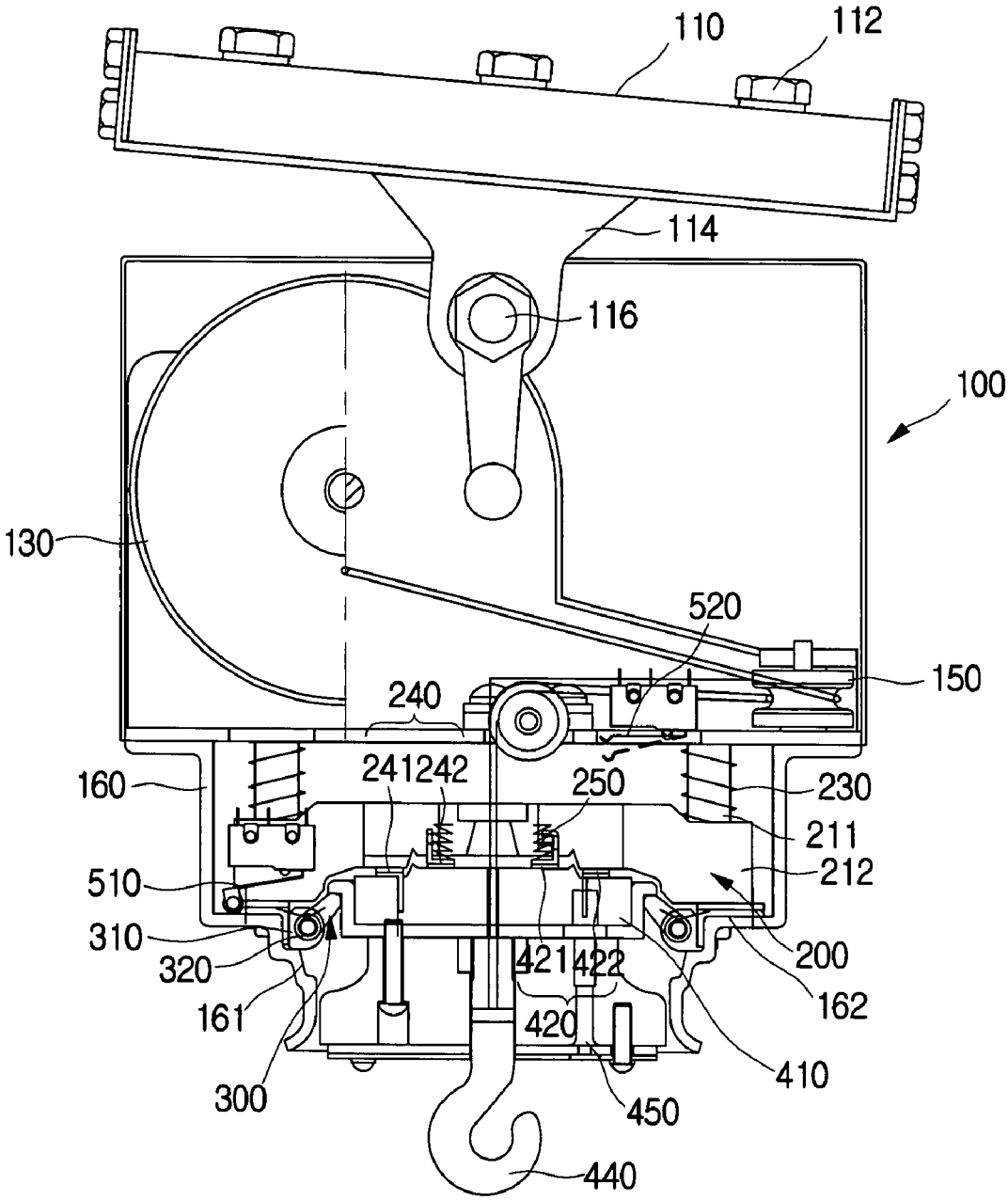
FIG. 5 is a side sectional view showing that the main body and the moving body of the high mounted lamp equipment according to the present invention are in a combined state.

FIGS. 2 to 5 are front and side views respectively showing inner configuration of the main body 100 and the moving body 400 provided in the high mounted lamp equipment of the present invention. In the figures, FIGS. 2 and 4 show a state that the main body 100 and the moving body 400 are separated, while FIGS. 3 and 5 show a state that the main body 100 and the moving body 400 are combined each other.

Referring the figures, the main body 100 is installed to a ceiling of a factory by the support bracket 110, in which the support bracket 110 is combined to the H beam mounted to the ceiling of a factory by a bolt 112, and a side bracket 114 extended from the support bracket 110 is combined to a side of the main body 100 by another bolt 116. At this time, though the support bracket 110 is mounted to an inclined ceiling, the main body 100 may be installed not to tilt by adjusting an angle between the main body 100 and the side bracket 114, as well shown in FIGS. 4 and 5.

Figure 6:
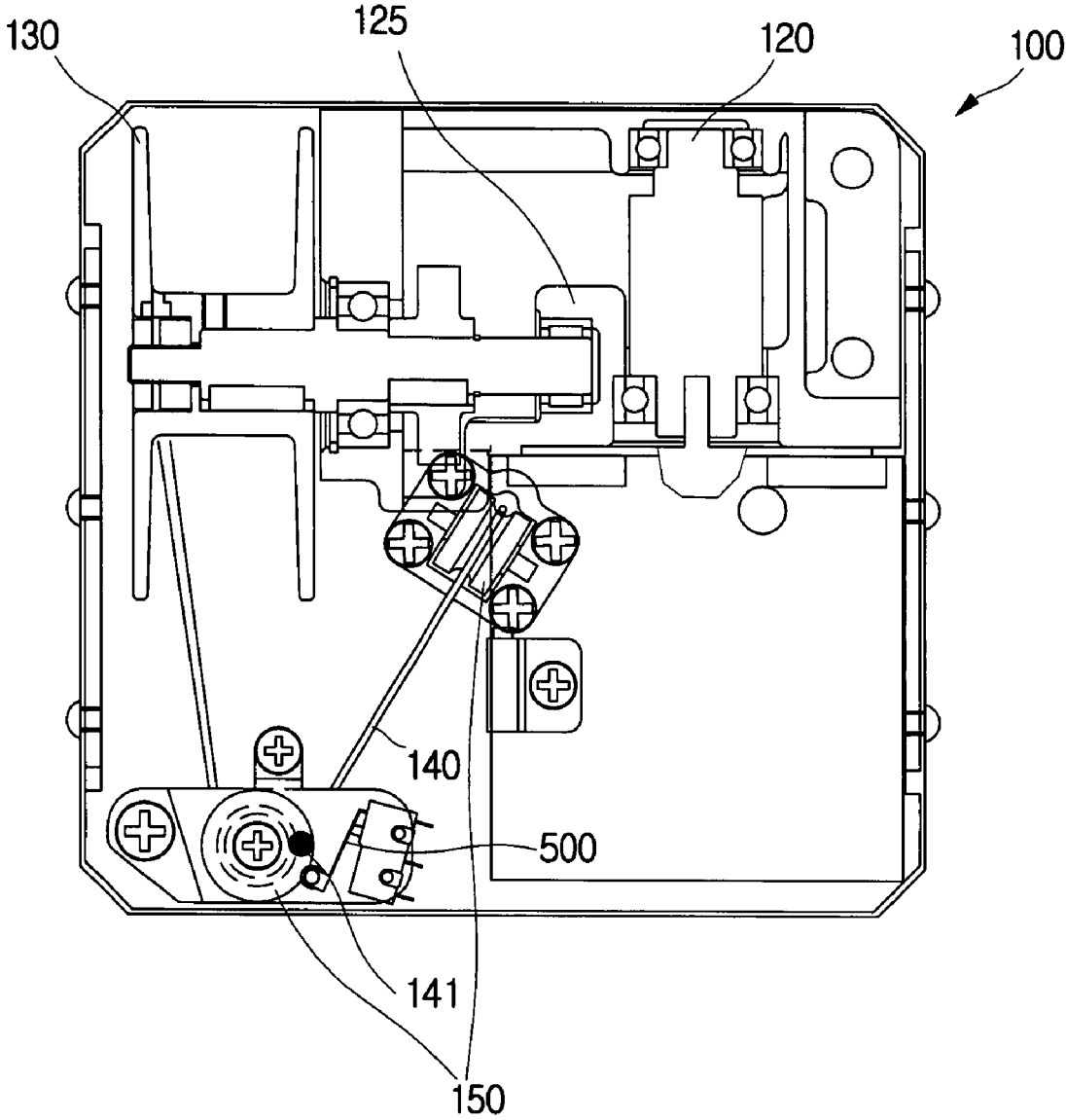
FIG. 6 is a plane view showing inner configuration of the main body of the high mounted lamp equipment according to the present invention.

The main body 100 has a space therein and a driving means for ascending and descending the moving body 400 is installed in that space. In more detail, a motor 120 is mounted to an inner side of the main body 100, and a drum 130 coaxially combined to the motor 120 is also mounted in the main body 100. The drum 130 rotates by driving force from the motor 120 to wind or release the wire rope 140 around the drum 130. In addition, a gearbox 125 (see FIG. 6) is installed between the motor 120 and the drum 130 to regulate a rotating speed of the drum 130.

And, at least one guide pulley 150 (see FIG. 6) is installed in the main body 100. The guide pulley 150 guides a direction of the wire rope 140 wound around the drum 130 to be oriented vertically downward from a center of the main body 100. Number and shape of the guide pulley 150 may be modified as required, and not limited to a specific example.

A casing 160 of a certain shape is fixed under the main body 100. The casing 160 has an open bottom so that the moving body 400 may enter into or exit from the casing 160, and an upper terminal unit 200 described below is installed in the casing 160. And, a stopper 300 described below is mounted in the casing 160, and a groove 161 is formed to the casing 160 to ensure a space where the stopper 300 may rotate. The stopper 300 and the groove 161 are described below in more detail.

Figure 7:
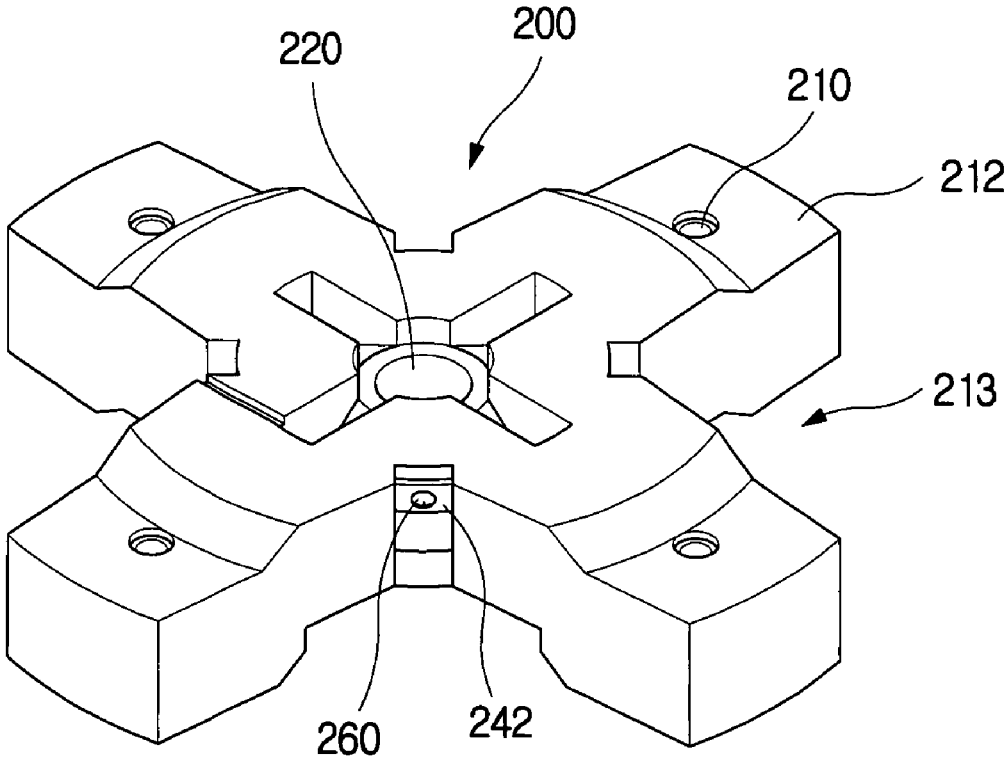
FIG. 7 is a perspective view showing an upper terminal unit of the high mounted lamp equipment according to the present invention.
Figure 8:
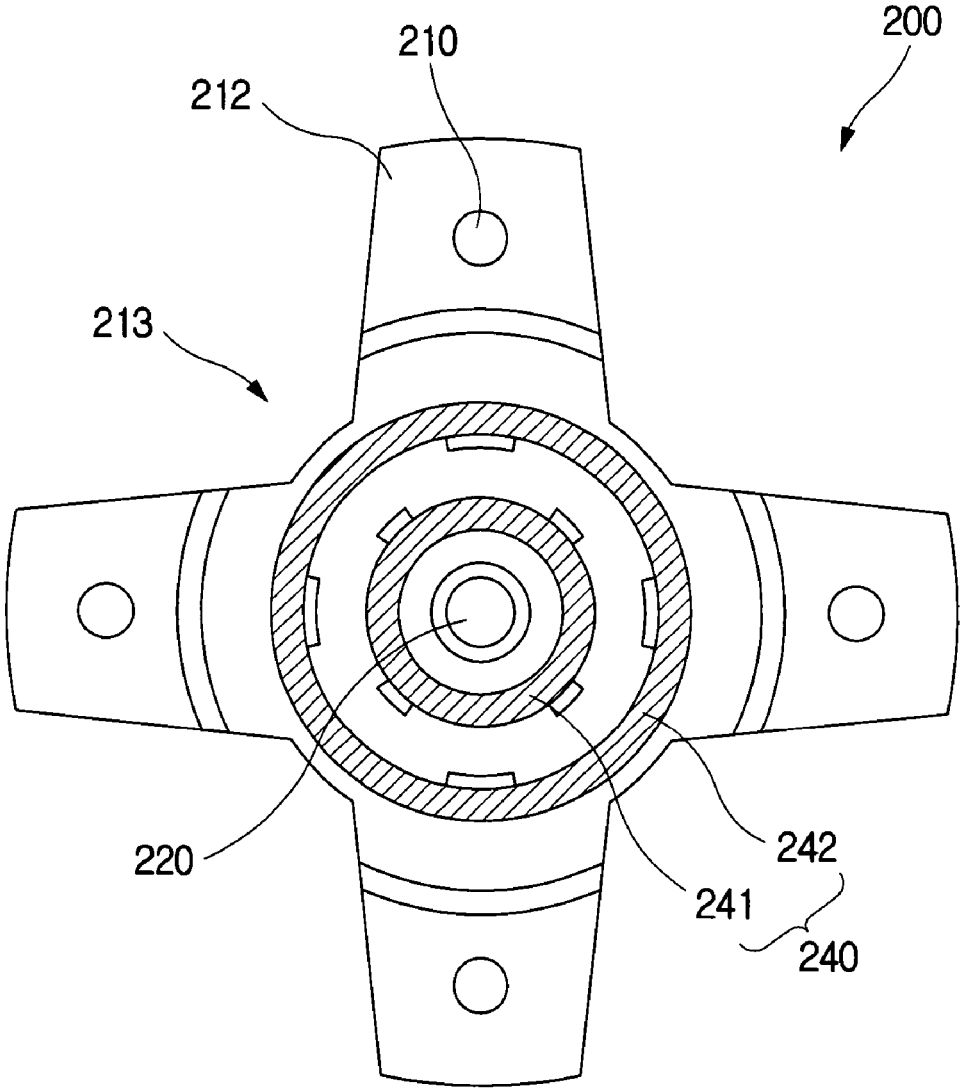
FIG. 8 is a bottom view showing the upper terminal unit of FIG. 7.

The upper terminal unit 200 is seated in the casing 160, and for this reason, a lower portion of the casing 160 is narrower than an upper portion thereof and the casing 160 has a projection 162 where the upper terminal unit 200 is seated. In addition, a guide rod 211 is mounted between the projection 162 of the casing 160 and a lower end of the main body 100, and a guide groove 210 is formed to the upper terminal unit 200 so that the guide rod 211 is inserted into. In the upper terminal unit 200, four guide grooves 210 are formed at approximately 90°, as well shown in FIGS. 7 and 8, which depict only the upper terminal unit 200. As shown in the figures, the upper terminal unit 200 has protruded support brackets 212 extended to four directions, and the guide grooves 210 are formed near an end of each protruded support bracket 212. And, a certain space 213 is formed between each protruded support bracket so that the stopper 300 is mounted and activated in the space 213. In addition, a center of a lower surface of the upper terminal unit 200 is flatly formed to have a disk shape with a constant diameter, and a through hole 220 is formed to a center of the upper terminal unit 200 so that the wire rope 140 may pass vertically through the upper terminal unit 200.

An upper contact terminal 240 having certain size and area is formed on the disk-shaped flat portion of the lower surface of the upper terminal unit 200. In the embodiment of the present invention, the upper contact terminal 200 has two circular ring-shaped contact terminals 241, 242, which are respectively called as an inner contact terminal 241 and an outer contact terminal 242. Such inner and outer contact terminals 241, 242 are inserted into the upper terminal unit 200 with one end being bent, and then fixed by a combining member 260. And, though not shown in the figures, the inner and outer contact terminals 241, 242 are electrically connected to a power source.

Figure 13:
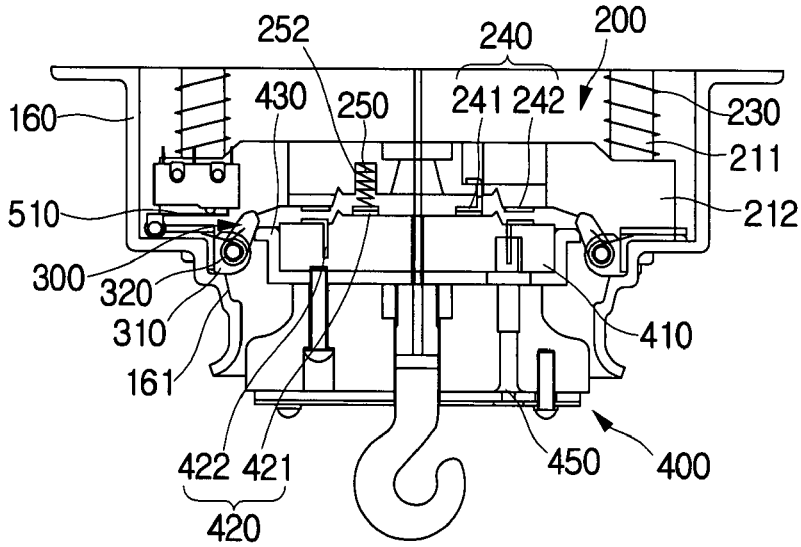
FIGS. 13 to 15 show changes of each unit according to height change of the moving body in the high mounted lamp equipment according to the present invention.
Figure 14:
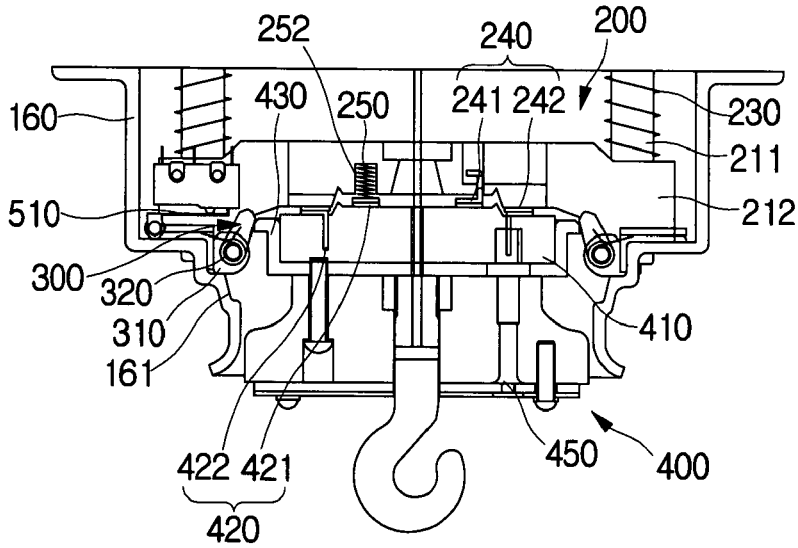
Figure 15:
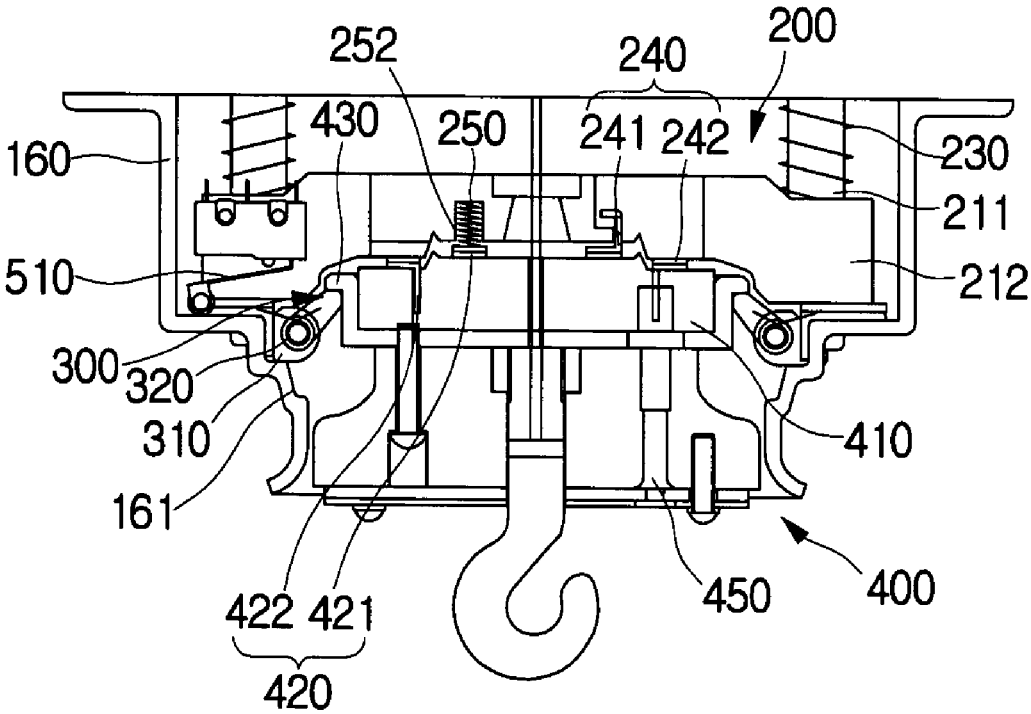

In addition, a spring 250 may be installed to the inner and outer contact terminals 241, 242. This spring 250 presses the upper contact terminal 240 downward when the moving body 400 is ascended and then fixed with pushing up the upper terminal unit 200 as described below, so as to maintain contact with a lower contact terminal 420 described below more firmly. At this time, the spring 250 may be installed to both of the inner and outer contact terminals 241, 242, or may be installed to any one of them. FIGS. 13 to 15 show that the spring 250 is installed only to the inner contact terminal 241, and the spring 250 is inserted into a spring groove 252 formed at a lower surface of the upper terminal unit 200.

An upper surface of the upper terminal unit 200 is spaced apart a predetermined distance from the main body 100, and the upper terminal unit 200 may move vertically along the guide rod 211. And, a spring 230 having certain elasticity is installed around the guide rod 211 between the main body 100 and the upper terminal unit 200 so as to elastically press the upper terminal unit 200 downward. Therefore, when the moving body 400 ascends, the upper terminal unit 200 is pushed by the upper contact terminal 420 mounted on the upper surface of the moving body 400 to move upward, and the upper terminal unit 200 is pressed by the spring 230 downward to maintain a contact state with the upper and lower contact terminals 240, 420.

The stopper 300 is installed at an inner wall of the casing 160 in the space 213 formed between the protruded support brackets 212 of the upper terminal unit 200 so as to selectively hook or unhook the moving body 400.

Figure 9:
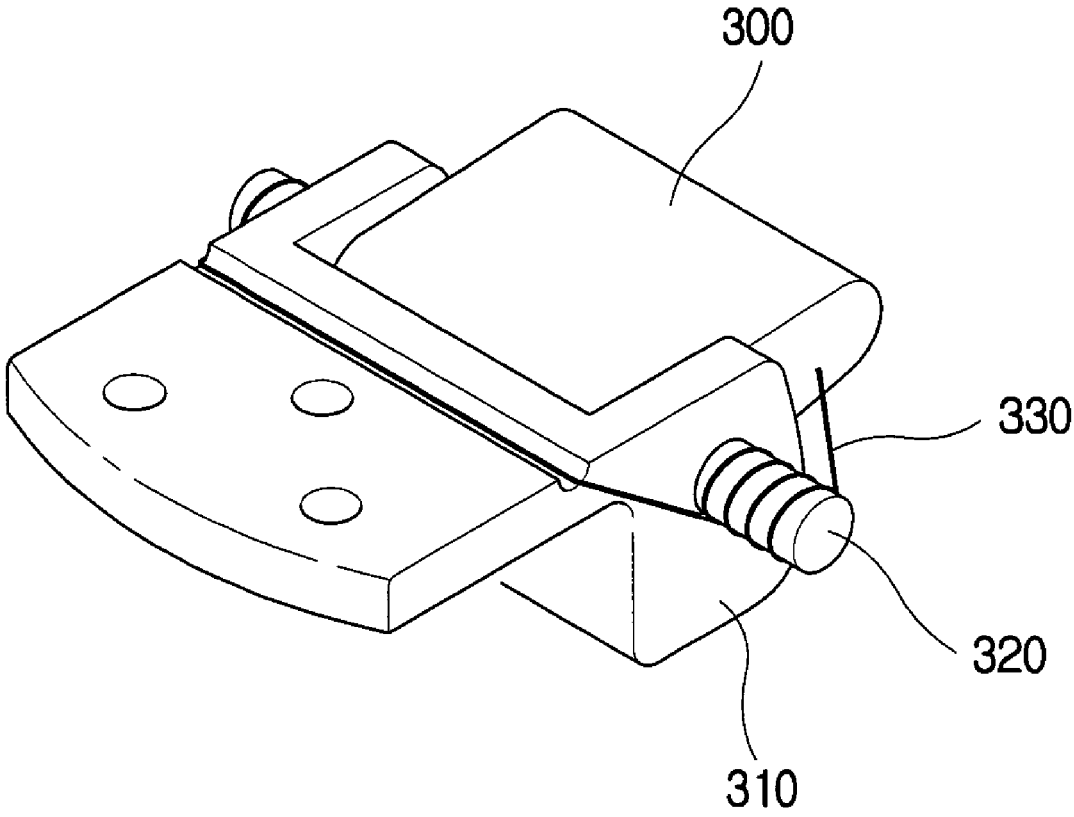
FIG. 9 is a perspective view showing a stopper of the high mounted lamp equipment according to the present invention.
Figure 10:
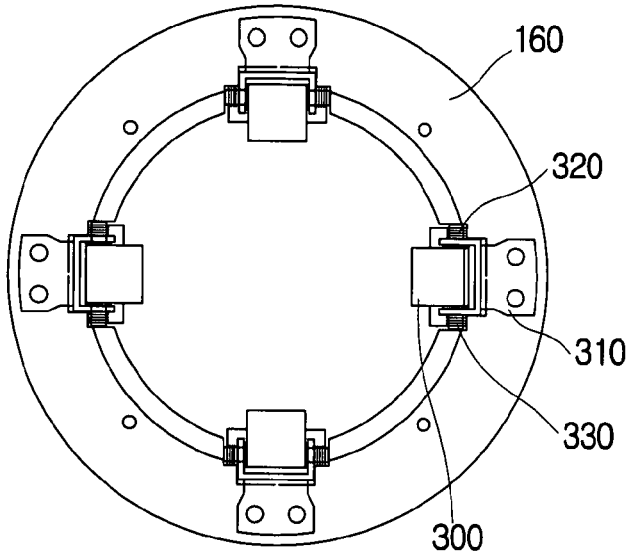
FIG. 10 is a plane view showing that the stopper of FIG. 9 is mounted to a casing of the main body.

Referring to FIGS. 9 and 10, such stoppers 400 are respectively combined with the brackets 310 mounted to the casing 160 at all spaces formed between protruded support brackets 212 of the upper terminal unit 200. At this time, the stopper 300 and the bracket 310 is connected by a hinge shaft so that the stopper 300 may rotate within a certain range. And, a spring 330 is installed to the hinge shaft 330 so as to maintain the stopper 300 at a horizontal state when no external force is exerted. The spring 300 is fixed to the bracket 310 at one end and fixed to the stopper 300 at the other end.

Figure 11:
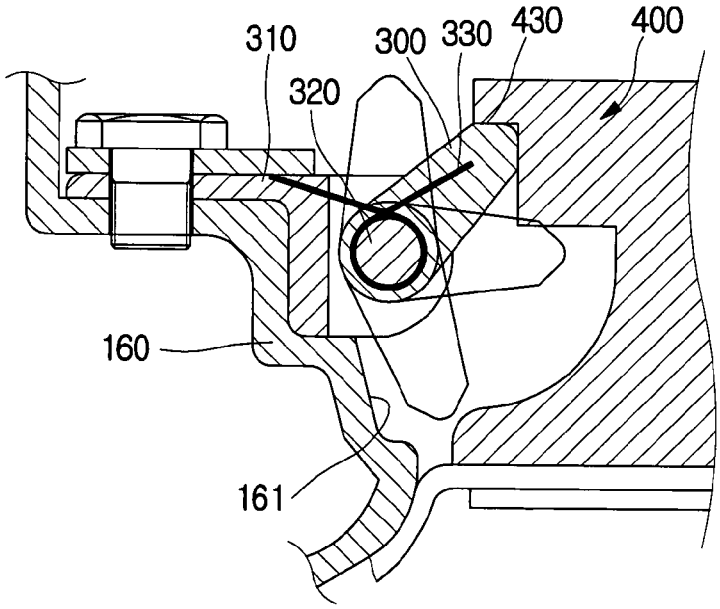
FIG. 11 shows a rotating range of the stopper shown in FIG. 9.
Figure 12:
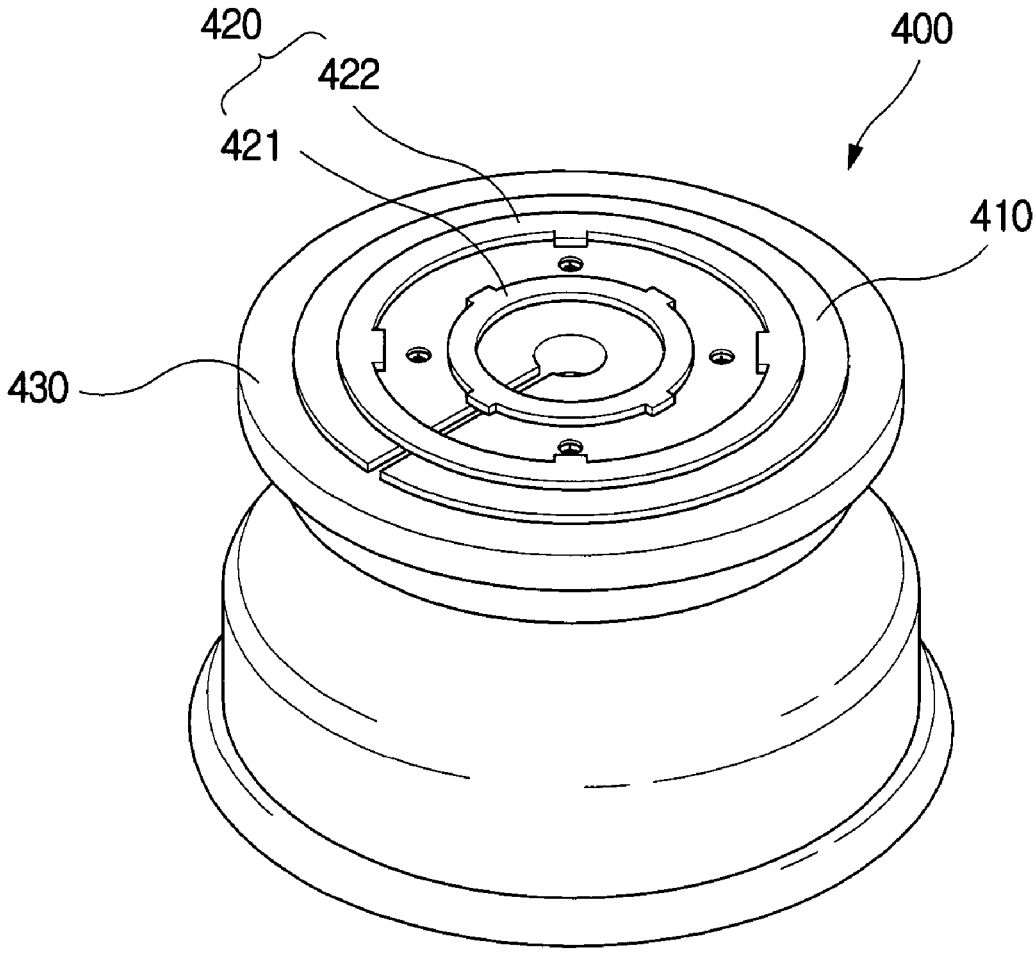
FIG. 12 is a perspective view showing the moving body of the high mounted lamp equipment according to the present invention.

At this time, in the area where the stopper 300 is installed, the casing 160 has sufficient space at an upper portion, but a lower portion has a narrowed width, which may interrupt rotation of the stopper 300. Therefore, a groove 161 is formed at the casing 160 below the stopper 300, that is the projection 162, so that the stopper 300 may rotate up to a certain range. In addition, an end of the stopper 300 preferably has a rounded shape so that the stopper 300 may be naturally pushed by a side of the moving body 400. Shapes of the stopper 300 and the groove 161 and a rotation range of the stopper 300 are well shown in FIG. 11.

On the other hand, though the stopper 300 working together with the spring is used in the present invention to fix a position of the moving body 400, any other structure may be adopted if it may fix the position of the moving body 400 suitably. For example, a solenoid type driving unit, which takes out or draws back a protrusion by electromagnetic field, may be applied instead of the stopper so that the protrusion is taken out to hook the moving body 400 when the moving body 400 is ascended and drawn back to unhook the moving body 400 when trying to descend the moving body 400.

The moving body 400 working together with the main body 100 by the wire rope 140 may move from a position completely contacted with the upper terminal unit 200 to the ground. Referring to FIGS. 2 and 5 to 12 together, this moving body 400 has a lower terminal unit 410 at an upper surface. The lower terminal unit 410 includes a lower contact terminal on an upper surface in correspondence to the upper contact terminal 240 of the upper terminal unit 200. At this time, the lower contact terminal 420 also has circular ring-shaped inner and outer contact terminals 421, 422, similar to the upper contact terminal 240. These inner and outer contact terminals 421, 422 are inserted into the lower terminal unit 410 with end ends being bent, and an inserted portion of each contact terminal 421, 422 is combined with the lower terminal unit 410 by a separate combining member.

And, a protrusion 430 is formed to an outer circumference of the moving body 400 to be in contact with the stopper 300. The protrusion 430 may push the stopper 300 to be rotated and act a role of fixing the position of the moving body 300 by being hooked to the stopper 300.

The connecting unit 440 used to install a lamp is mounted under the moving body 400 and this connecting unit 440 may have a shape of hook, screw or the like. And, a wire groove 450 is formed to the moving body 400 to guide a wire connected to the lamp toward the lower contact terminal 420.

On the other hand, an end of the wire rope 140 is fixed to an upper center of the moving body 400, and at this time the wire rope 140 should have so sufficient strength to endure load of the moving body during ascending and descending. And, the wire rope 140 should have a suitable length to possibly descend near the ground in consideration of surroundings in which the lamp is installed, and have flexibility so that it may be wound around the drum 130 by guidance of the guide pulley 150. In addition, in consideration of circumstance of the work place, particularly a height of the installed lamp, a contact mark 141 to be detected by a first limit switch 500 described below is mounted at a predetermined position of the wire rope 140. The contact mark 141 is made by wrapping a surface of a part of the wire rope 140 with a lead bead or rubber packing, and comes in contact with the first limit switch 500 when the moving body 400 ascends to a predetermined height. And, if the contact mark 141 comes in contact with the first limit switch 500, the power supply to the motor 120 is connected and disconnected at a very short interval to wind up the wire rope 140 slowly.

The time that the contact mark 141 comes in contact with the first limit switch 500 is when the lower contact terminal 420 of the moving body 400 reaches near the upper contact terminal 240 of the upper terminal unit 200, so that the moving body 400 ascends slowly from that time to contact the lower contact terminal 420 and the upper contact terminal 240 smoothly. Driving the motor 120 slowly as described above is realized only by connecting and disconnecting the power supply at a very short interval without using any current adjustment device. Therefore, such a driving method does not require other auxiliaries such as encoder or inverter to control rotation speed of the motor 120, which reduces manufacturing costs and makes the equipment more stable because of not using the encoder and the inverter, which are frequently malfunctioned.

Such a contact mark may be also mounted to an uppermost portion of the wire rope 140. This contact mark 142 is wound around the drum 130 when the moving body 400 is at a high position, while unwound and detected by the first limit switch 500 when the moving body 400 descends to a predetermined height near the ground, and from that time the power supply to the motor 120 is connected and disconnected at a very short interval to move the lamp 10 slowly. In this case, because the moving body 400 moves more slowly at a position near the ground, it may prevent the lamp from collide with other structures installed on the ground.

Referring to FIGS. 4, 5 and 13 to 15, a second limit switch 510 is mounted to a certain position of the sidewall of the casing 160. The second limit switch 510 detects that the upper terminal 200 ascends and plays a role of releasing driving of the motor 120 and supplying power to the lamp. That is, the upper terminal unit 200 moves upward a little when the moving body 400 ascends so that the lower contact terminal 420 comes in contact with the upper contact terminal 240, and the second limit switch 510 detects the contact and stops driving of the motor 120.

In addition, a third limit switch 520 is installed at a lower portion of the main body 100, and the third limit switch 520 detects a point of descending the moving body 400. The stopper 300 hooked upon the protrusion 430 should be released in order to descend the moving body 400, and for that reason the moving body 400 should be moved upward up to a predetermined height in advance. At this time, the upper terminal unit 200 is ascended together with pressing the spring 230 mounted to the guide rod 211. At this time, if an upper surface of the upper terminal unit 200 reaches the third limit switch 520, the side of the moving body 400 is entirely deviated from the stopper 300, and then the third limit switch 520 transmits a signal for inversely driving the motor 120 to move the moving body 400 downward.

FIGS. 16*a* to 16*e* and 17*a* to 17*g* respectively show the process that the moving body 400 ascends to be hooked by the stopper 300 and the process that the moving body 400 is unhooked from the stopper 300 to descend. Now, operational principles of each limit switch and the stopper are described in detail, referring to those figures.

Figure 16A:
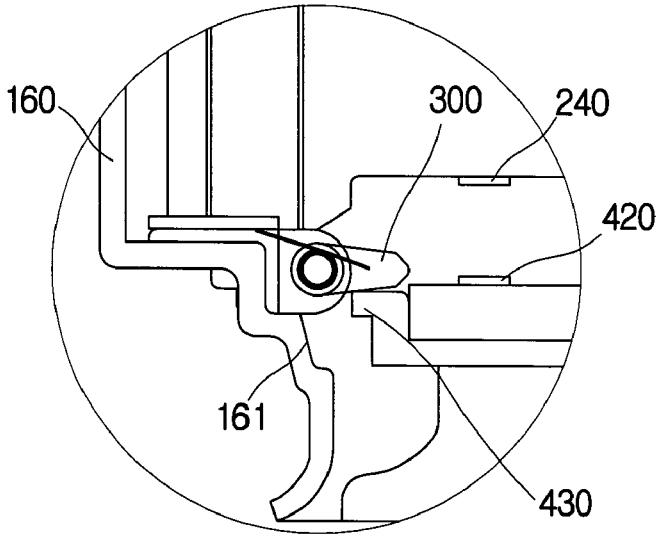
FIGS. 16*a* to 16*e* are for illustrating relative movements of the stopper and the moving body while the moving body ascends.
Figure 16B:
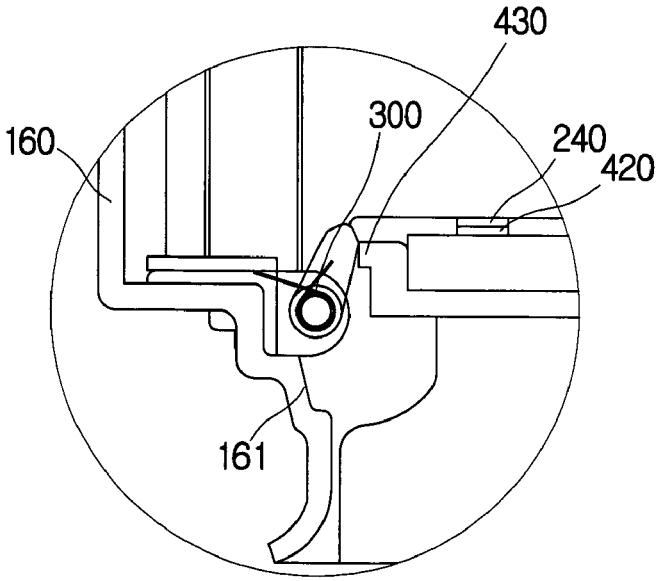
Figure 16C:
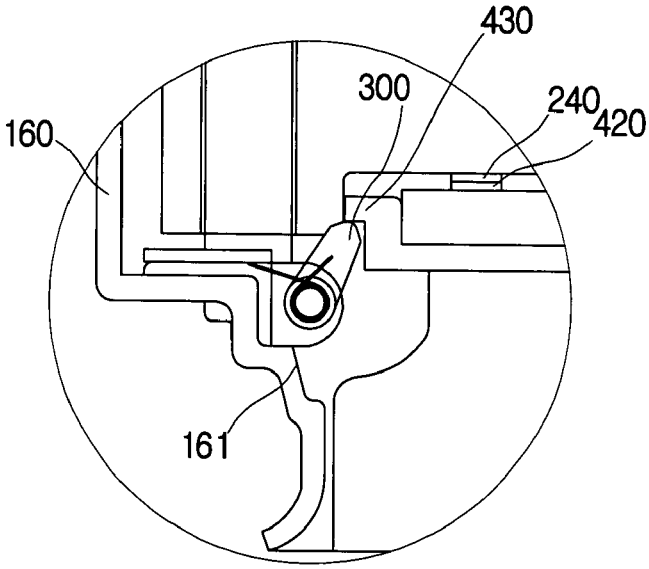
Figure 16D:
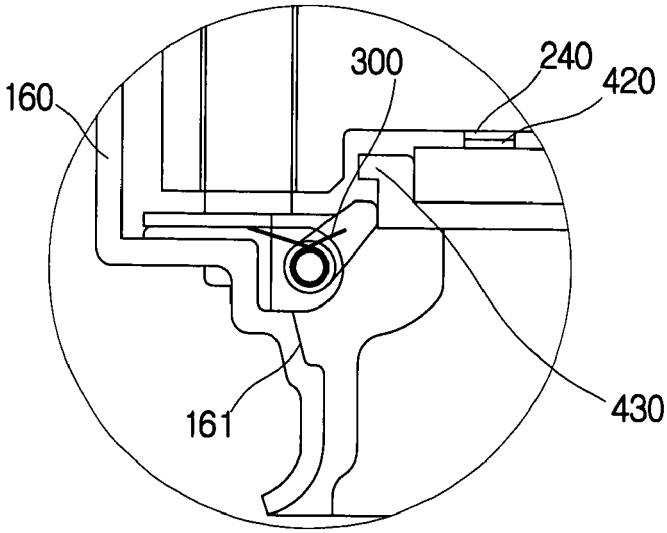
Figure 16E:
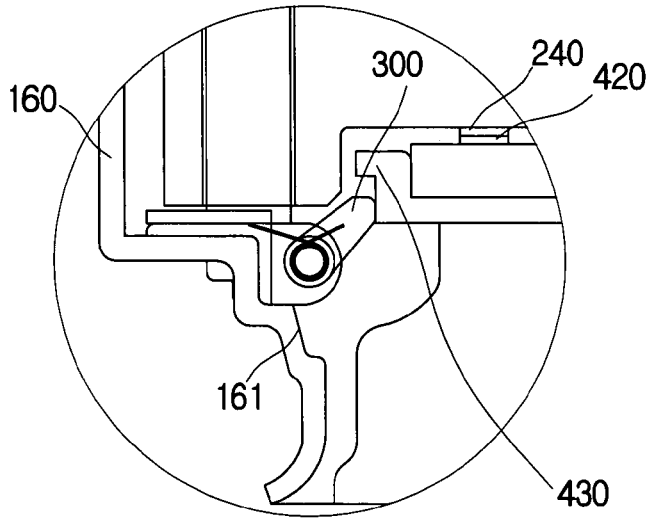

In the ascending process first, the moving body 400 continuously ascends until the contact mark 141 of the wire rope 140 comes in contact with the first limit switch 500, and from that time the power supply to the motor 120 is repeatedly connected and disconnected at a very short interval so that the moving body 400 ascends slowly. If the moving body 400 ascends more, the protrusion 430 of the moving body 400 comes in contact with the stopper 300 at a horizontal state as shown in FIG. 16*a*. In this state, the moving body 400 ascends more as shown in FIG. 16*b*, so that the protrusion 430 pushes up the stopper 300 and the lower contact terminal 420 of the lower terminal unit 410 contacts with the upper contact terminal 240 of the upper terminal unit 200. In this state, the moving body 400 continuously ascends and pushes up the upper terminal unit 200 as shown in FIG. 16*c*, and the second limit switch 510 detects it just before the protrusion 430 is deviated from the stopper 300 and stops driving of the motor 120. At this time, the protrusion 430 becomes deviated from the stopper 300 as shown in FIG. 16*d* due to its inertia. Then, the motor 120 is instantaneously driven inversely so that the protrusion 430 moves downward and is then hooked upon the stopper 300 as shown in FIG. 16*e*. Then the upper terminal unit 200 is pressed down by the spring 230 mounted to the guide rod 211 so that the upper and lower contact terminals 240, 420 are firmly contacted each other. And, because the upper and lower contact terminal 240, 420 keep their contacting state at this time, the power source is supplied to the lamp 10 through the contact terminals 240, 420 according to the signal of the second limit switch 510 so as to turn on the lamp 10.

Now, the operation while the moving body 400 is descending is as follows.

Figure 17A:
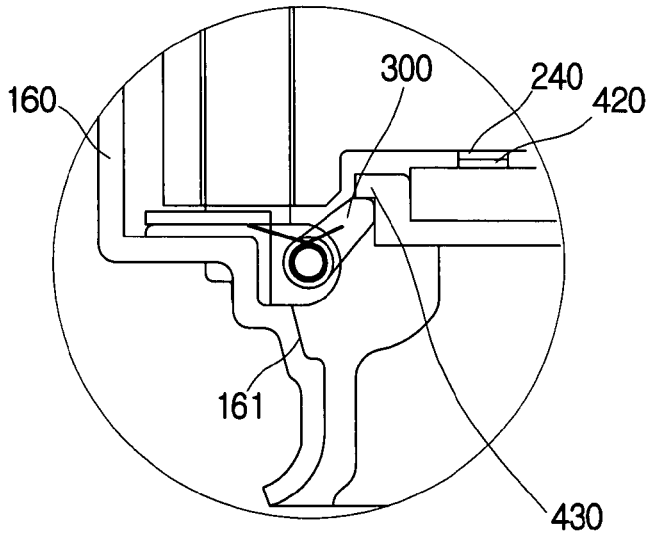
FIGS. 17*a* to 17*g* are for illustrating relative movements of the stopper and the moving body while the moving body descends.
Figure 17B:
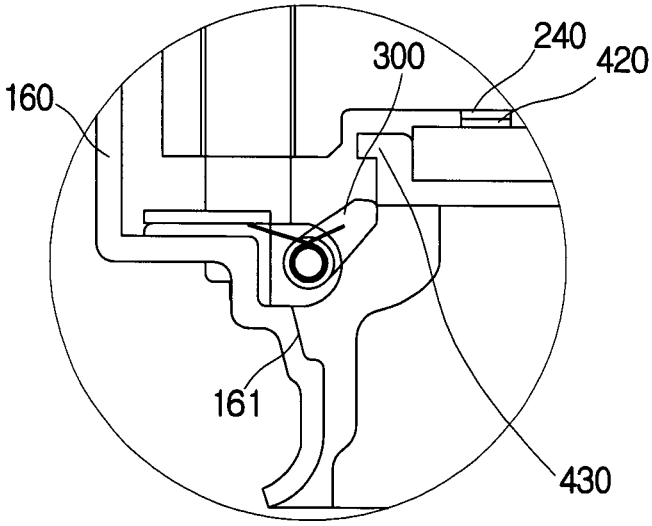
Figure 17C:
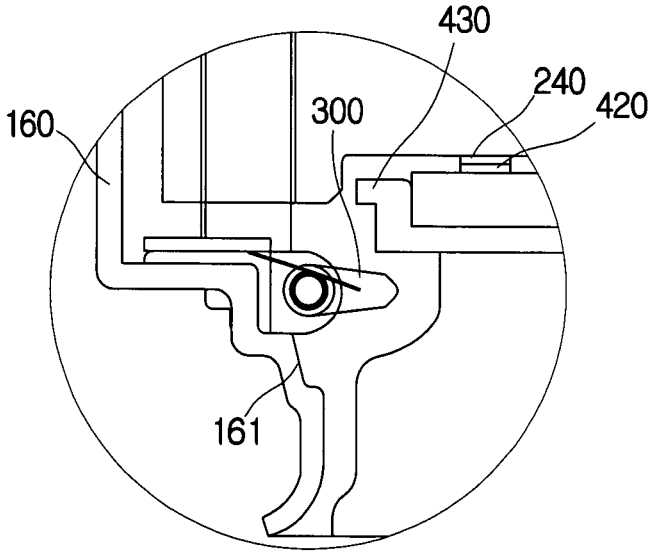
Figure 17D:
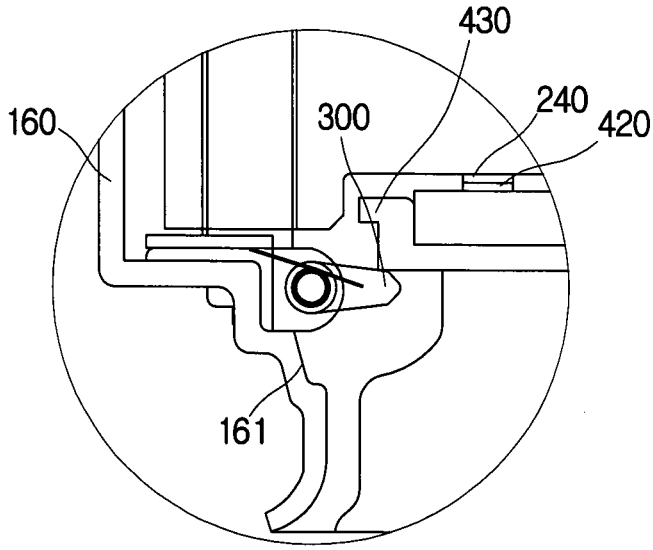
Figure 17E:
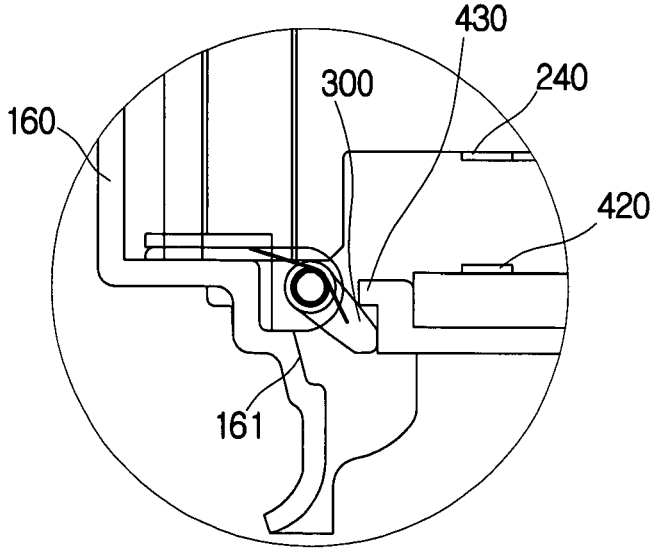
Figure 17F:
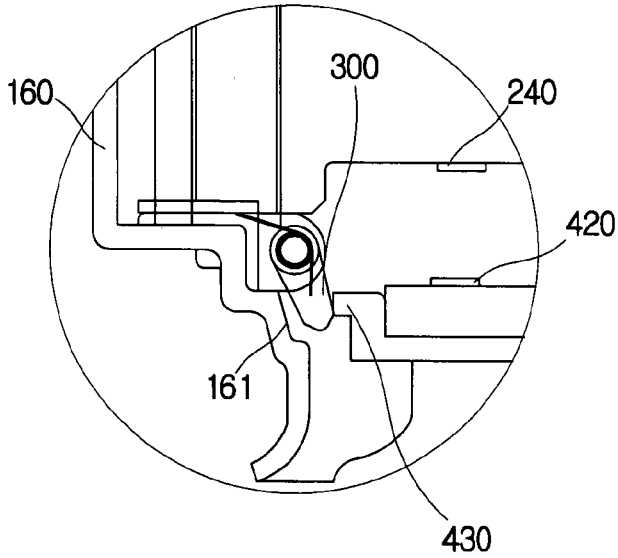
Figure 17G:
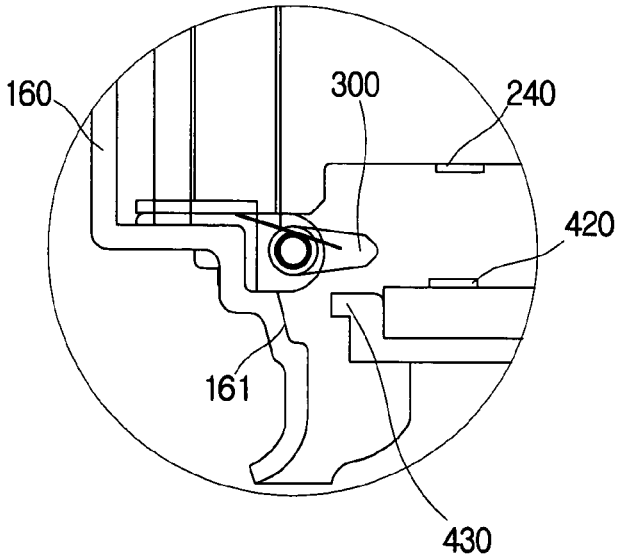
Figure 18A:
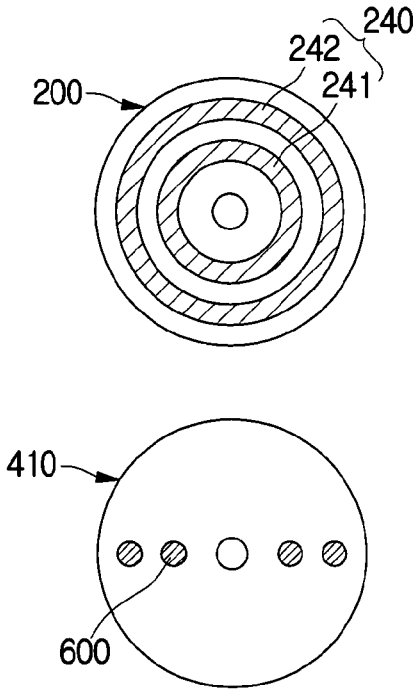
FIGS. 18*a* to 20*b* shows various examples of each contact terminal applied to the high mounted lamp equipment according to the present invention.
Figure 18B:
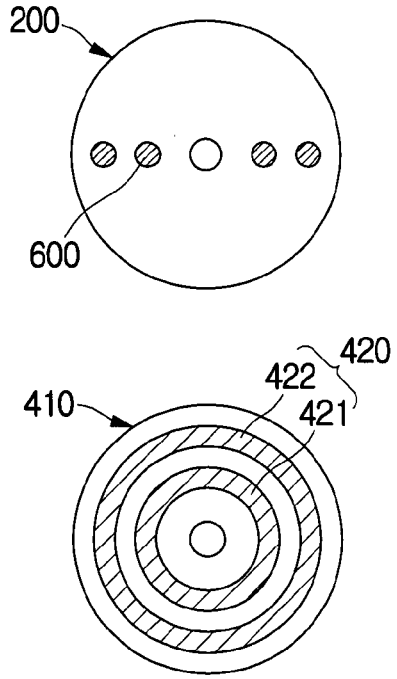

First, the power source supplied to the lamp 10 is blocked as soon as a descending signal is received. Then, in a state that the protrusion 430 of the moving body 400 is hooked upon the stopper 300 as shown in FIG. 17*a*, the motor 120 is driven to draw up the moving body 400 (see FIG. 17*b*). Then, the motor 120 keeps ascending the moving body 400 until the stopper 300 is entirely deviated from the side of the moving body 400, and the upper terminal unit 200 is ascended together to a position approximately contacting with the lower surface of the main body 100. At this time, the stopper 300 is entirely deviated from the side of the moving body 400 and recovers its horizontal state due to the spring 330. And at this time, the upper terminal unit 200 comes in contact with the third limit switch 520 mounted to the lower surface of the main body 100, and from this time, the motor 120 is driven inversely according to a detect signal of the third limit switch 520 to move the moving body 400 downward. At this time, the upper terminal unit 200 is also moved downward together by restoring force of the spring 230 with guidance of the guide rod 211. Therefore, the moving body 400 descends and a lower end of the moving body 400 then comes in contact with the stopper 400 as shown in FIG. 17*d*. In this state, the motor 120 is continuously driven so that the wire rope 140 keeps unwinding from the drum 130 to move the moving body 400 downward by gravity, and therefore the side and the protrusion 430 of the moving body 400 pass over the stopper 300 and the stopper 300 is pushed to pivotally move toward the groove 161 of the casing 160. At this time, the upper terminal unit 200 is seated on the projection 162 of the casing 160 to stop at a predetermined position, and therefore the upper contact terminal 240 of the upper terminal unit 200 becomes separated from the lower contact terminal 420 of the lower terminal unit 410. After that, if the protrusion 430 of the moving body 400 is completely deviated from the stopper 300, the stopper 300 recovers its horizontal state owing to restoring force of the spring 330.

FIGS. 18*a* to 20*b* show various examples of the upper contact terminal 240 mounted at the upper terminal unit 200 and the lower contact terminal 420 at the lower terminal unit 410. In the above embodiment, the upper and lower contact terminals 240, 420 are described to respectively have two corresponding circular ring-shaped contact terminals 241, 242 and 421, 422. This configuration is to ensure stable contact between the terminals because each circular ring-shaped contact terminal 241, 242 and 421, 422 is surface-contacted. However, it is also possible that the lower contact terminal 420 has four contact points 600 positioned at radii corresponding to the upper contact terminal 240. Because the moving body 400 and the upper terminal unit 200 match their center with the wire rope 140 when drawing up the moving body 400, the contact points 600 formed at the lower terminal unit 410 of the moving body 400 come in contact with the upper contact terminal 240 separated as much as the same distance from the wire rope 140. This result can be obtained though the moving body 400 rotates at a center of the wire rope 140. And, to the contrary, as shown in FIG. 18*b*, it is also possible that the upper contact terminal 240 has four contact points 600 and the lower contact terminal 420 has two circular ring-shaped terminals.

Figure 19A:
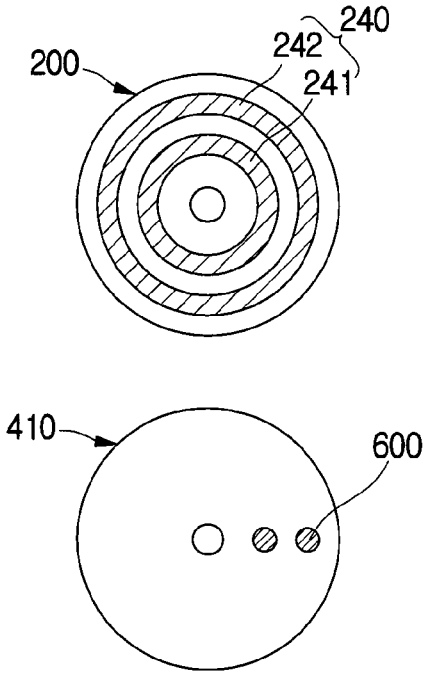
Figure 19B:
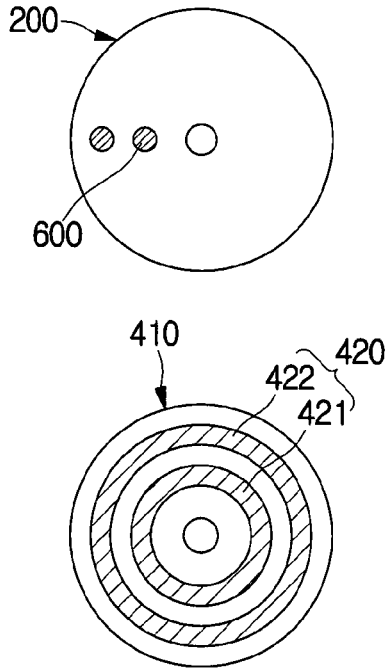
Figure 20A:
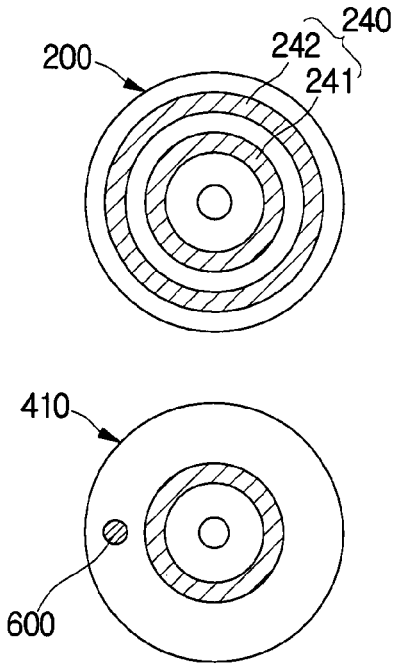
Figure 20B:
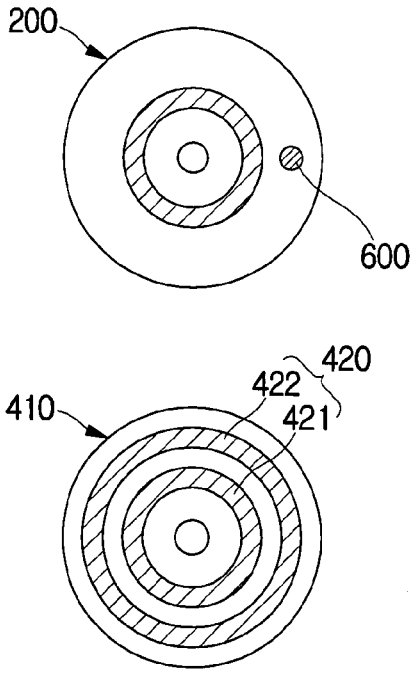

In addition, such configuration of the contact terminals 240, 420 may be modified so that one contact terminal has two circular ring-shaped terminals and the other contact terminal has two contact points 600, each of which is formed at a radius corresponding to each ring-shaped terminal, as shown in FIGS. 19*a* and 19*b*. As another example, as shown in FIGS. 20*a* and 20*b*, it is also possible that one contact terminal has two circular ring-shaped terminals, while the other contact terminal has one ring-shaped terminal (421 in FIG. 20*a* and 241 in FIG. 20*b*) and one contact terminal 600. This configuration of the contact terminals 240, 420 may be also changed to any shape other than the above examples if it ensures stable contact, of course. For example, the upper and lower contact terminals 240, 420 may have a polygonal shape such as a hexagon instead of the ring shape, and not limited to any specific case.

In the above cases of FIGS. 18*a* to 20*b*, the ring-shaped terminal can be replaced with a semicircular or arc terminal just if it ensures safe contact between the contact terminals 240, 420 of both upper and lower terminal units 200, 410. This modification of the contact terminal may be advantageous in costs.

The high mounted lamp equipment of the present invention as above may be installed to a building such as gymnasium, factory, wedding hall, hotel lobby and so on, and to a streetlight. In this case, there can be installed just one lamp or more depending on circumstance. In some cases, several thousands of lamps are installed together. Therefore, the controller 900 for manipulating the high mounted lamp equipment of the present invention is preferably configured so that a user may handle a plurality of high mounted lamp equipments at the same time. For example, it is possible that, after endowing a serial number to each lamp equipment, the user selects a desired high mounted lamp equipment and then deals with only the equipment. In addition, the controller 900 may also have a function of handling all of the high mounted lamp equipments installed in a building. Such a controller 900 can be operated in wire or wireless, and in case of a wireless controller, a transmitter should be provided to the controller 900 and a receiver for receiving a radio signal from the controller should be also provided to each high mounted lamp equipment.

Figure 21:
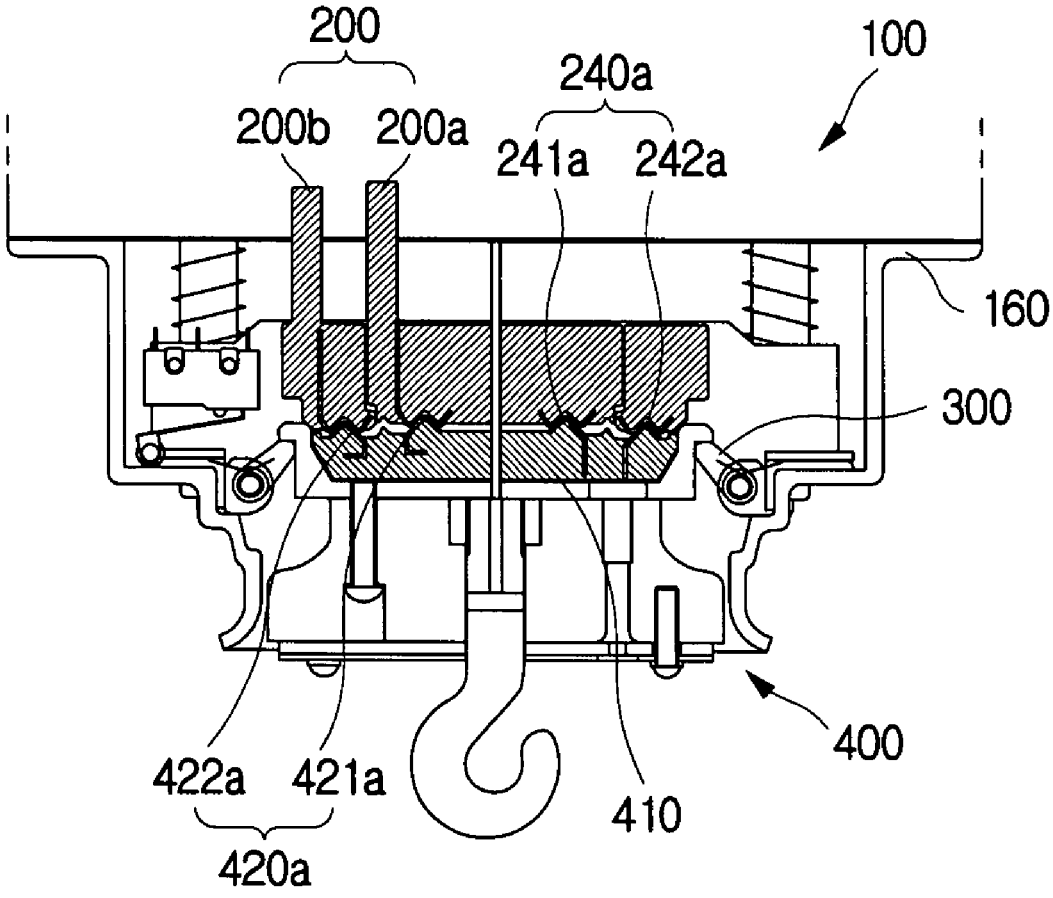
FIG. 21 is a sectional view showing upper and lower terminal units of the equipment for a highly mounted lamp according to another embodiment of the present invention.

On the other hand, FIG. 21 shows an equipment for a highly mounted lamp according to another embodiment of the present invention. The equipment of the present invention is identical to the former embodiment, except the upper terminal unit 200 and the lower terminal unit 410.

In the present embodiment, the upper terminal unit 200 is positioned in the casing 160 mounted below the main body 100, and the lower terminal unit 410 is installed to the moving body 400 so as to move together with the moving body 400, similar to the former embodiment.

At this time, the upper terminal unit 200 has upper contact terminals 240*a* which are composed of an inner contact terminal 241*a* and an outer contact terminal 242*a*, which respectively have a ring shape. In addition, the ring-shaped inner and outer contact terminals 241*a* and 242*a* are formed so that a portion, preferably a center portion, is bent upward. At this time, the upper terminal unit 200 may be separated into two pieces at a point between the inner and outer contact terminal 241*a* and 242*a* so that the inner contact terminal 241*a* and the outer contact terminal 242*a* are installed in different pieces. In this case, the inner contact terminal 241*a* and the outer contact terminal 242*a* do not interfere each other though they are pressed and deformed.

Similarly, the lower terminal unit 410 has lower contact terminals 420*a* which are composed of an inner contact terminal 421*a* and an outer contact terminal 422*a*. The inner and outer contact terminals 421*a* and 422*a* also have a ring shape, respectively. The ring-shaped inner and outer contact terminals 421*a* and 422*a* of the lower terminal unit 410 are formed so that a portion, preferably a center portion, is bent upward.

Thus, the inner contact terminals 241*a* and 421*a* and the outer contact terminals 242*a* and 422*a* of the upper and lower terminal units 200 and 410 are all bend correspondingly, so the protruded portion formed at the center of each contact terminal 421*a* and 422*a* of the lower terminal unit 410 is inserted into the groove formed at the center of each contact terminal 241*a* and 242*a* of the upper terminal unit 200. This makes the contact area between the inner contact terminals 241*a* and 421*a* as well as the outer contact terminals 242*a* and 422*a* of the upper and lower terminal units 200 and 410 broader. In addition, since the inner and outer contact terminals 421*a* and 422*a* of the lower terminal unit 410 are formed to protrude upward, dusts or impurities on the inner and outer contact terminals 421*a* and 422*a* of the lower terminal unit 410 naturally drop down, not piled up thereon.

Figure 22A:
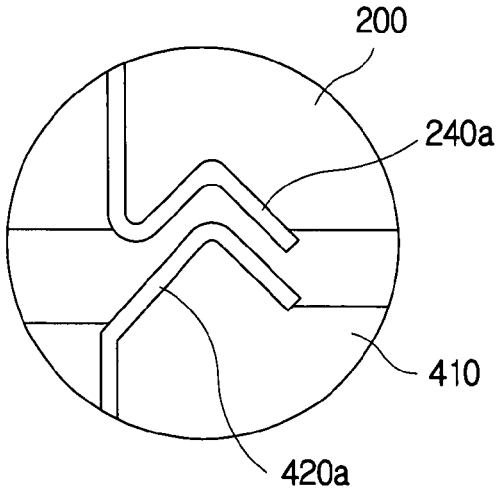
FIGS. 22*a* and 22*b* show upper and lower contact terminals of FIG. 21 in detail.
Figure 22B:
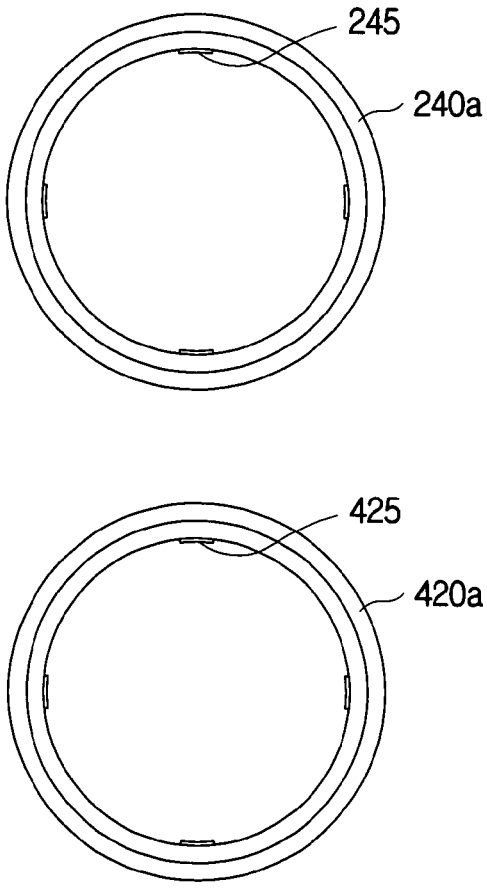

FIG. 22*a* is an enlarged view schematically showing the upper contact terminal 240*a* and the lower contact terminal 420*a* according to the present embodiment, and FIG. 22*b* is a plane view showing the upper contact terminal 240*a* and the lower contact terminal 420*a*. Referring to FIGS. 22*a* and 22*b*, the upper and lower contact terminals 240*a* and 420*a* are respectively inserted and fixed to the upper and lower terminal units 200 and 410 at a plurality of fitting points 245 and 425, and formed so that their center is bent toward.

Figure 23A:
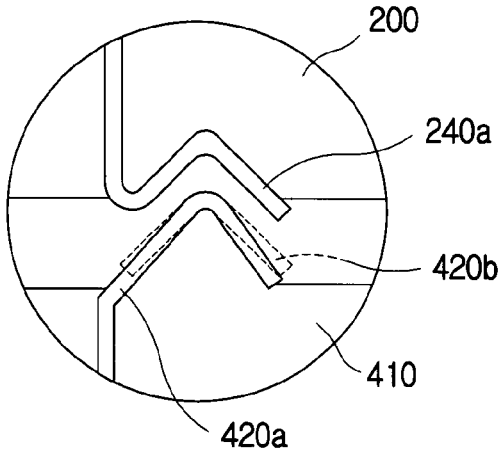
FIGS. 23*a* and 23*b* show modification of the upper and lower contact terminals of FIG. 21.
Figure 23B:
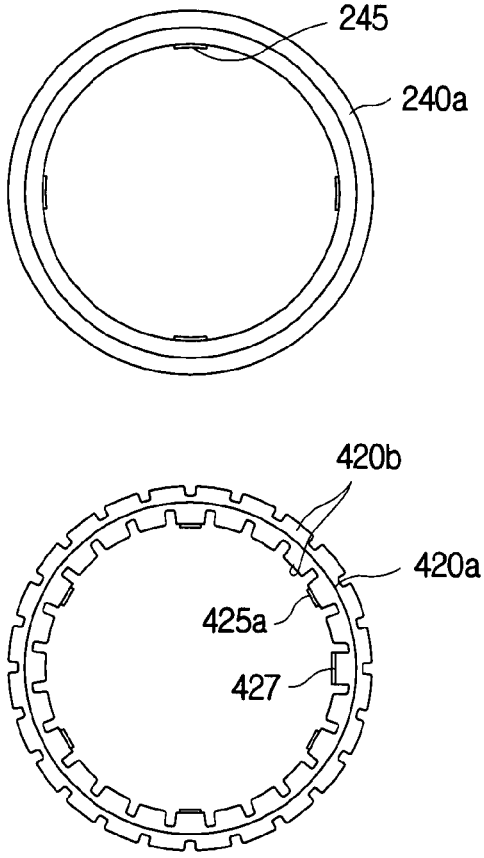

FIGS. 23*a* and 23*b* show a modified example of the above-mentioned upper and lower contact terminal 240*a* and 420*a*. In this modified example, the upper contact terminal 240*a* is identical to that of FIGS. 22*a* and 22*b*, but the lower contact terminal 420*a* has a plurality of elastic flaps 420*b*, differently from that shown in FIGS. 22*a* and 22*b*. The elastic flaps 420*b* are formed in inner and outer circumferences of the lower contact terminal 420*a* by means of regular gaps. In addition, the elastic flaps 420*b* are positioned at both sides on the basis of the center of the lower contact terminal 420*a*. This elastic flap 420*b* has elasticity and keeps a little afloat upward rather than both ends of the lower contact terminal 420*a* so that the elastic flaps 420*b* are elastically contacted with the upper contact terminal 240*a* in advance when the lower terminal unit 410 moves upward. This helps the upper and lower contact terminals 240*a* and 420*a* to contact stably, and particularly prevents the upper and lower contact terminals 240*a* and 420*a* from being deformed due to temperature change or external impact. In addition, since the lower contact terminal 420*a* is formed to be protruded upward at its center similarly to the former case of FIGS. 22*a* and 22*b*, dusts and impurities upon the lower contact terminal 420*a* naturally drop down, not piled up thereon, thereby making the upper and lower contact terminals 240*a* and 420*a* contact stably.

Reference numeral 425*a* denotes a fitting portion formed on the lower contact terminal 420*a* and fitted into the lower terminal unit 410, and reference numeral 427 denotes a wire connection portion for connecting a wire to the lower contact terminal 420*a*.

Figure 24A:
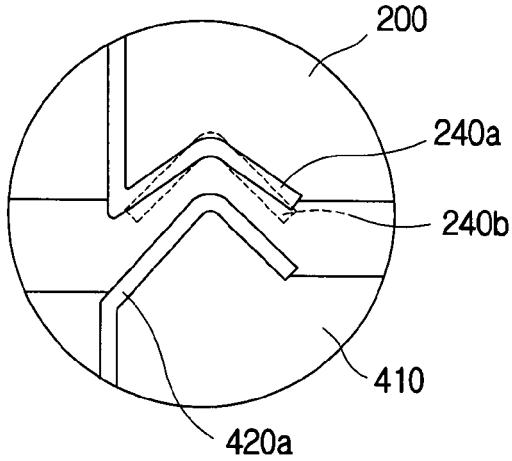
FIGS. 24*a* and 24*b* show another modification of the upper and lower contact terminal of FIG. 21.
Figure 24B:
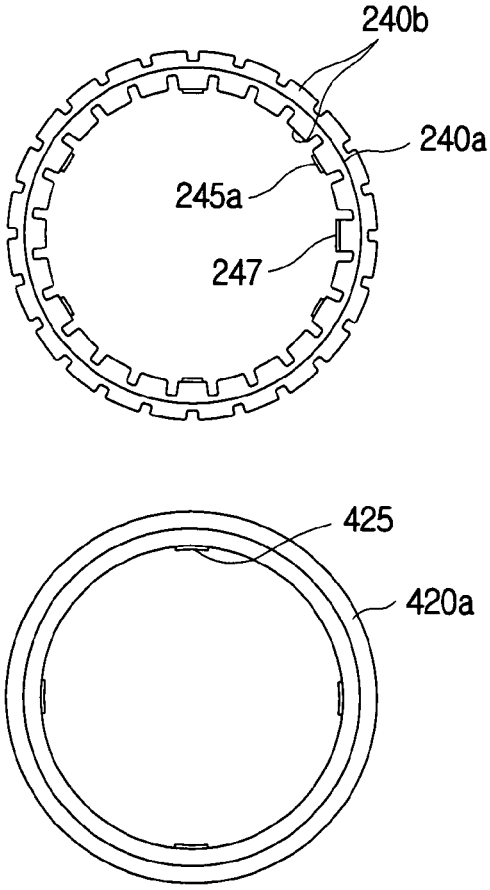

FIGS. 24*a* and 24*b* show another modified example of the above-mentioned upper and lower contact terminal 240*a* and 420*a*. In this modified example, the lower contact terminal 420*a* is identical to that of FIGS. 22*a* and 22*b*, but the upper contact terminal 240*a* has a plurality of elastic flaps 240*b*, differently from that shown in FIGS. 22*a* and 22*b*. The elastic flaps 240*b* are formed in inner and outer circumferences of the upper contact terminal 240*a* by means of regular gaps. In addition, the elastic flaps 240*b* are positioned at both sides on the basis of the center of the upper contact terminal 240*a*. This elastic flap 240*b* has elasticity and keeps a little afloat downward rather than both ends of the upper contact terminal 240*a* so that the elastic flaps 240*b* are elastically contacted with the lower contact terminal 420*a* in advance when the lower terminal unit 410 moves upward. This helps the upper and lower contact terminals 240*a* and 420*a* to contact stably, and particularly prevents the upper and lower contact terminals 240*a* and 420*a* from being deformed due to temperature change or external impact.

Reference numeral 245*a* denotes a fitting portion formed on the upper contact terminal 240*a* and fitted into the upper terminal unit 200, and reference numeral 247 denotes a wire connection portion for connecting a wire to the upper contact terminal 240*a*.

Figure 25A:
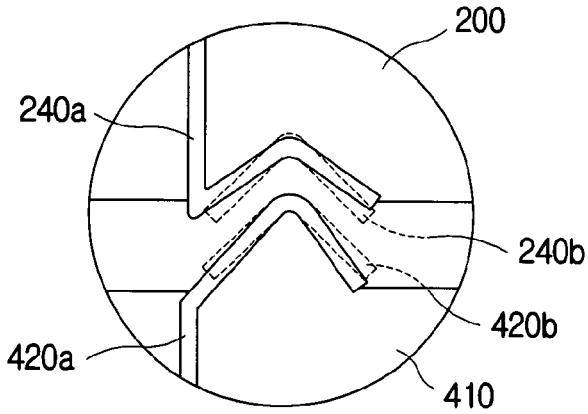
FIGS. 25*a* and 25*b* show still another modification of the upper and lower contact terminal of FIG. 21.
Figure 25B:
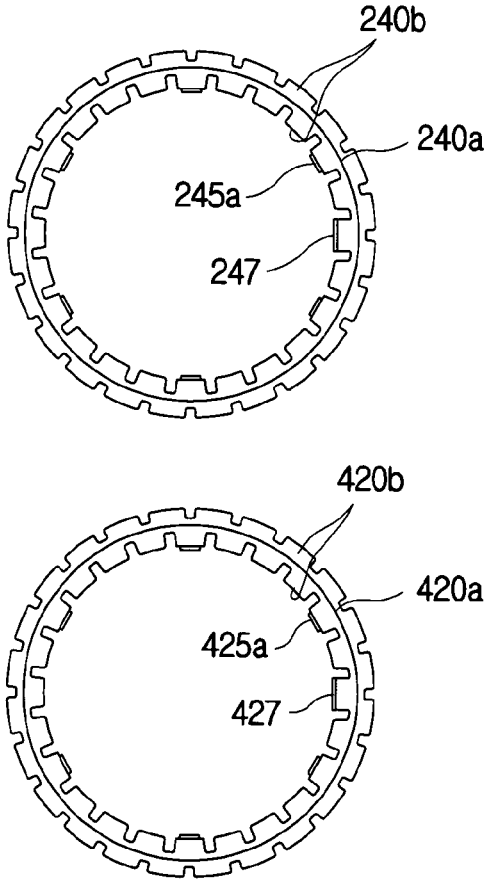

FIGS. 25*a* and 25*b* show still another modified example of the above-mentioned upper and lower contact terminal 240*a* and 420*a*. In this modified example, both of the upper and lower contact terminals 240*a* and 420*a* have a plurality of elastic flaps 240*b* and 420*b* respectively, differently from those shown in FIGS. 22*a* and 22*b*. The elastic flaps 240*b* formed in the upper contact terminal 240*a* are a little afloat downward at both sides of the upper contact terminal 240*a*, and the elastic flaps 420*b* formed in the lower contact terminal 420*a* are a little afloat upward at both sides of the lower contact terminal 420*a*. Thus, when the lower terminal unit 410 moves upward, the elastic flaps 240*b* and 420*b* of the upper and lower contact terminals 240*a* and 420*a* are elastically contacted in advance. This helps the upper and lower contact terminals 240*a* and 420*a* to contact stably, and particularly prevents the upper and lower contact terminals 240*a* and 420*a* from being deformed due to temperature change or external impact, similar to the former modified examples.

INDUSTRIAL APPLICABILITY

The high mounted lamp equipment of the present invention as described above may move the lamp, mounted at a high position such as a ceiling of a building or a streetlight, to the ground with only one wire rope, so giving advantages of easy repair and change.

In addition, the high mounted lamp equipment of the present invention is structurally stable and lack of breakdown because the protrusion of the moving body may be combined and released with the main body by working together with the stopper and the stopper may support the moving body stably when being combined with the main body.

Furthermore, the upper and lower terminal units may be stably surface-contacted without deviation of the terminals, and the contact between the terminals can be stably maintained by pressing the terminals with the spring.

The present invention has been described in detail. However, it should be understood that the detailed description and specific examples, while indicating preferred embodiments of the invention, are given by way of illustration only, since various changes and modifications within the spirit and scope of the invention will become apparent to those skilled in the art from this detailed description.

What is claimed is:

1. An equipment for a high mounted lamp having ascending and descending functions, comprising:

a main body installed to a certain height and having a drum for winding a wire rope and a motor for rotating the drum;

a casing mounted under the main body and having an open bottom;

an upper terminal unit installed in the casing to be spaced apart from the main body and having at least one upper contact terminal at a lower end;

a moving body connected to the wire rope to be vertically movable by the motor, the moving body having a connecting unit to install a lamp thereto and a lower contact terminal mounted to an upper end thereof corresponding to the upper contact terminal; and a stopper installed to the casing for fixing the moving body in the state that the upper and lower contact terminals are contacted each other, wherein both the upper and lower contact terminals have a ring shape, wherein the upper and lower contact terminals are respectively formed so that a center portion is bent upward, and wherein a plurality of elastic flaps are formed in inner and outer circumferences of the ring-shaped upper contact terminal so that the elastic flaps are afloat in at least one of a downward and upward orientation rather than both ends of the upper contact terminal.

2. The equipment for a high mounted lamp having ascending and descending functions as claimed in claim 1, wherein the upper contact terminals formed at the upper terminal unit include circular ring-shaped inner and outer contact terminals, and wherein the lower contact terminals formed at the moving body include circular ring-shaped inner and outer contact terminals corresponding to the upper contact terminals.

3. The equipment for a high mounted lamp having ascending and and descending functions as claimed in claim 1, wherein the upper contact terminals formed at the upper terminal unit include circular ring-shaped inner and outer contact terminals, and wherein the lower contact terminals formed at the moving body include four contact points positioned at a same radius as the inner and outer contact terminals.

4. The equipment for a high mounted lamp having ascending and descending functions as claimed in claim 1, wherein the lower contact terminals formed at the moving body include circular ring-shaped inner and outer contact terminals, and wherein the upper contact terminals formed at the upper terminal unit include four contact points positioned at a same radius as the inner and outer contact terminals.

5. The equipment for a high mounted lamp having ascending and descending functions as claimed in claim 1, wherein the upper contact terminals formed at the upper terminal unit include circular ring-shaped inner and outer contact terminals, and wherein the lower contact terminals formed at the moving body include two contact points positioned at a same radius as the inner and outer contact terminals.

6. The equipment for a high mounted lamp having ascending and descending functions as claimed in claim 1, wherein the lower contact terminals formed at the moving body include circular ring-shaped inner and outer contact terminals, and wherein the upper contact terminals formed at the upper terminal unit include two contact points positioned at a same radius as the inner and outer contact terminals.

7. The equipment for a high mounted lamp having ascending and descending functions as claimed in claim 1, wherein a spring is installed to at least one of the upper contact terminals mounted to the upper terminal unit so as to press the corresponding upper contact terminal toward the moving body.

8. The equipment for a high mounted lamp having ascending and descending functions as claimed in claim 1, wherein the stopper is rotatably mounted to the casing to elastically maintain a horizontal state by a spring, and wherein a protrusion is formed at a side of the moving body at a position partially contacted with the stopper so that the protrusion is hooked on the stopper when descending after ascending above the stopper in order to fix the height of the moving body, while the protrusion is unhooked from the stopper when moving above the stopper in order to make the moving body be movable downward.

9. The equipment for a high mounted lamp having ascending and descending functions as claimed in claim 8, wherein a contact mark is mounted to a predetermined position of the wire rope and a first limit switch is installed to the main body to come in contact with the contact mark when the moving body reaches the upper terminal unit so as to drive the moving body slowly by repeatedly connecting/disconnecting power of the motor at a short interval after the first limit switch detects the contact mark during the ascent of the moving body.

10. The equipment for a high mounted lamp having ascending and descending functions as claimed in claim 9, wherein an additional contact mark of a predetermined length is mounted to an upper end of the wire rope so that the first limit switch comes in contact with the additional contact mark from the time that the moving body approaches near the ground during the descent of the moving body and makes the moving body descend slowly and then stop by repeatedly connecting/disconnecting power of the motor.

11. The equipment for a high mounted lamp having ascending and descending functions as claimed in claim 8, wherein a guide rod is mounted between the main body and the casing to pass through the upper terminal unit so that the upper terminal unit vertically moves along the guide rod, and wherein a spring is installed to the guide rod between the upper terminal unit and the main body so as to press the upper terminal unit downward.

12. The equipment for a high mounted lamp having ascending and descending functions as claimed in claim 10, wherein a second limit switch is installed to the casing for detecting that the upper terminal unit ascends to a predetermined height in order to determine a point of time that the protrusion of the moving body deviates from the stopper, and wherein the motor is stopped in receipt of a detect signal of the second limit switch.

13. The equipment for a high mounted lamp having ascending and descending functions as claimed in claim 12, wherein the motor, which is stopped by the detect signal of the second limit switch, is temporarily driven inversely as soon as the protrusion deviates from the stopper in order to slightly move the moving body downward.

14. The equipment for a high mounted lamp having ascending and descending functions as claimed in claim 8, wherein a third limit switch is installed under the main body to come in contact with the upper terminal unit whether the upper terminal unit ascends so that the stopper completely deviates from the side of the moving body, and wherein the motor is driven inversely in receipt of a detect signal of the third limit switch to descend the moving body.

* * * * *